US007372779B2

(12) United States Patent
Takada et al.

(10) Patent No.: US 7,372,779 B2
(45) Date of Patent: May 13, 2008

(54) RADIO CONTROLLED TIMEPIECE AND METHOD OF CONTROLLING THE SAME

(75) Inventors: Akinari Takada, Tokyo (JP); Takashi Ihara, Tokyo (JP); Masaaki Namekawa, Tokyo (JP); Masami Fukuda, Tokyo (JP); Minoru Kobayashi, Tokyo (JP)

(73) Assignee: Citizen Holdings Co., Ltd., Tokyo (JP)

( * ) Notice: Subject to any disclaimer, the term of this patent is extended or adjusted under 35 U.S.C. 154(b) by 383 days.

(21) Appl. No.: 10/498,701

(22) PCT Filed: Sep. 5, 2003

(86) PCT No.: PCT/JP03/11376

§ 371 (c)(1),
(2), (4) Date: Dec. 20, 2004

(87) PCT Pub. No.: WO2004/023223

PCT Pub. Date: Mar. 18, 2004

(65) Prior Publication Data

US 2005/0094495 A1 May 5, 2005

(30) Foreign Application Priority Data

Sep. 6, 2002 (JP) ..... 2002-260878

(51) Int. Cl.
*G04B 19/22* (2006.01)
*G04C 11/02* (2006.01)

(52) U.S. Cl. ..... 368/21; 368/47

(58) Field of Classification Search ..... 368/46, 368/47, 21; 455/13.2, 500, 502
See application file for complete search history.

(56) References Cited

U.S. PATENT DOCUMENTS 4,582,434 A * 4/1986 Plangger et al. ..... 368/46
5,068,838 A * 11/1991 Klausner et al. ..... 368/47
5,247,440 A * 9/1993 Capurka et al. ..... 701/49
5,408,444 A * 4/1995 Kita et al. ..... 368/47
5,490,122 A * 2/1996 Kojima ..... 368/21

(Continued)

FOREIGN PATENT DOCUMENTS

JP 54-127358 10/1979

(Continued)

*Primary Examiner*—Vit W Miska
(74) *Attorney, Agent, or Firm*—Greer, Burns & Crain, Ltd.

(57) ABSTRACT

The invention is directed to obtaining a radio controlled timepiece that, in a case when the user who uses it moves from one country or one region to another where the time difference is different, has simplified an operation of correcting the time difference between the countries or regions and an operation of correcting the time difference due to daylight saving time's being executed. To this end, the invention provides a radio controlled timepiece 1 that, in addition to the radio controlled timepiece 1 in the prior art, it further includes offset time difference information storage means 8 that stores an offset time difference between a country where reference time information is formed and a country where a standard radio wave has been received and daylight saving time information storage means 9 that has stored therein for future use information on whether daylight saving time is being executed in the region where the standard radio wave has been received, and local standard time information forming means 10 that, with respect to the reference time information of the standard radio wave that has been received in a particular region, executes calculation processing by using at least either one of offset time difference information with respect to the reference time information corresponding to the particular region and daylight saving time information in the particular region, to thereby form local standard time information in the particular region.

21 Claims, 18 Drawing Sheets

U.S. PATENT DOCUMENTS

| | | | | |
|---|---|---|---|---|
| 5,901,115 | A * | 5/1999 | Katzmann et al. | 368/21 |
| 6,269,055 | B1 * | 7/2001 | Pikula et al. | 368/47 |
| 6,278,660 | B1 * | 8/2001 | Tognazzini | 368/21 |
| 6,304,618 | B1 * | 10/2001 | Hafeez et al. | 375/341 |
| 6,563,765 | B1 * | 5/2003 | Ishigaki | 368/47 |
| 6,876,600 | B2 * | 4/2005 | Ito et al. | 368/21 |

FOREIGN PATENT DOCUMENTS

| | | |
|---|---|---|
| JP | 63-250584 | 10/1988 |
| JP | 6-160551 | 6/1994 |
| JP | 7-012966 | 1/1995 |
| JP | 2001-108769 | 4/2001 |
| JP | 2001-235568 | 8/2001 |
| JP | 2002-196088 | 7/2002 |

* cited by examiner

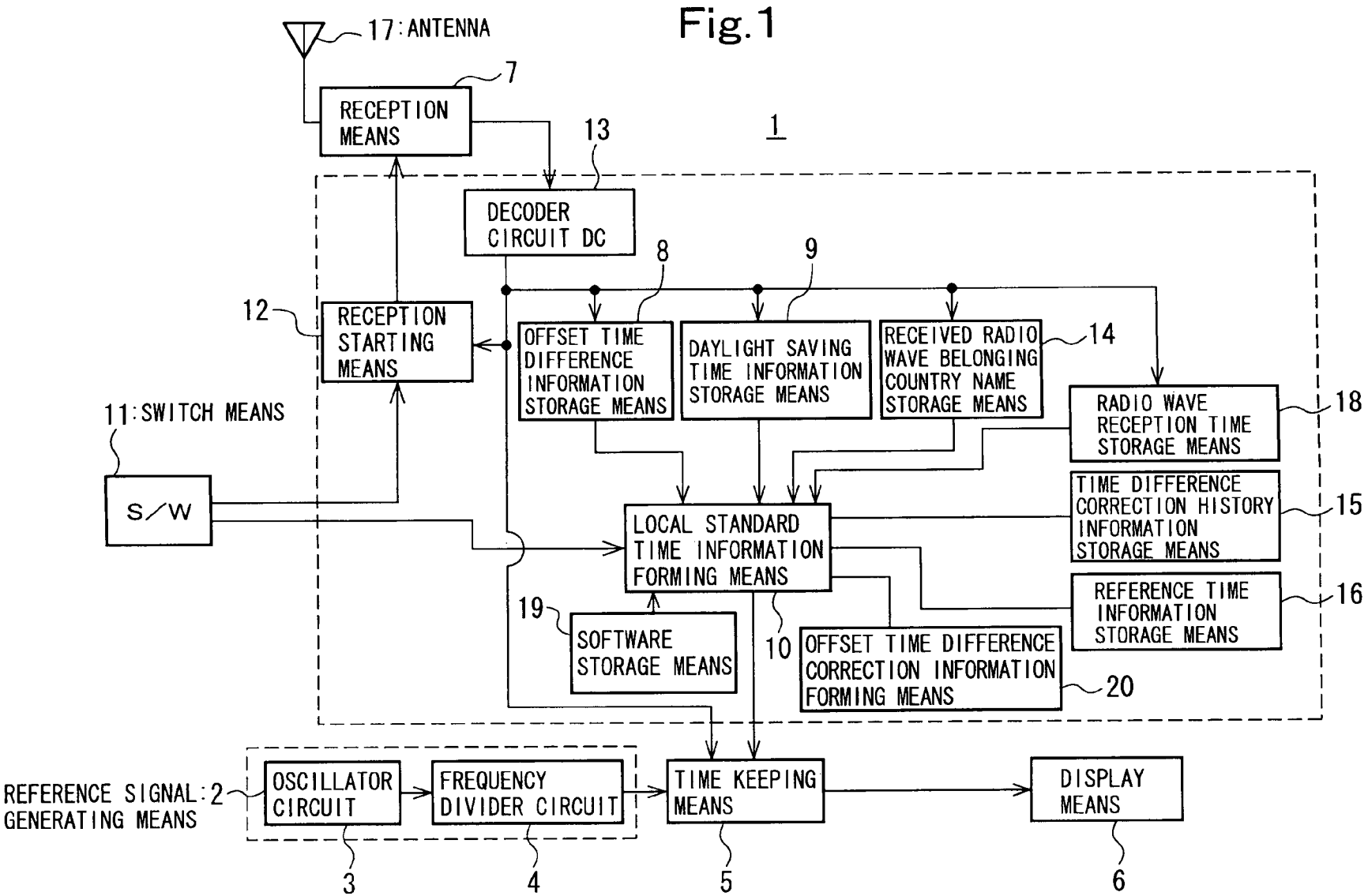
Fig.1
1
17:ANTENNA
7
RECEPTION MEANS
13
DECODER CIRCUIT DC
8
OFFSET TIME DIFFERENCE INFORMATION STORAGE MEANS
9
DAYLIGHT SAVING TIME INFORMATION STORAGE MEANS
14
RECEIVED RADIO WAVE BELONGING COUNTRY NAME STORAGE MEANS
18
RADIO WAVE RECEPTION TIME STORAGE MEANS
15
TIME DIFFERENCE CORRECTION HISTORY INFORMATION STORAGE MEANS
16
REFERENCE TIME INFORMATION STORAGE MEANS
20
OFFSET TIME DIFFERENCE CORRECTION INFORMATION FORMING MEANS
10
LOCAL STANDARD TIME INFORMATION FORMING MEANS
19
SOFTWARE STORAGE MEANS
12
RECEPTION STARTING MEANS
11:SWITCH MEANS
S/W
5
TIME KEEPING MEANS
6
DISPLAY MEANS
4
FREQUENCY DIVIDER CIRCUIT
3
OSCILLATOR CIRCUIT
2
REFERENCE SIGNAL GENERATING MEANS

Fig.2

JP TIME CODE FORMAT (1) FORMAT OTHER THAN HOURLY 15 MIN. / 45 MIN. FORMAT CUEING CURRENT TIME 0 10 20 30 40 50 59

P 40 20 10 8 4 2 1 P1 20 10 8 4 2 1 P2 200100 80 40 20 10 P3 8 4 2 1 PAPASUP4SU 80 40 20 10 8 4 2 1 P5 4 2 1 LS LS2 P0

0 0 0 0 0 0 0 0 0 0 0 0

MINUTE | HOUR | DAY FOR ADJUSTMENT | YEAR | WEEK (2) HOURLY 15 MIN. / 45 MIN. FORMAT 0 10 20 30 40 50 59

P 40 20 10 8 4 2 1 P1 20 10 8 4 2 1 P2 200100 80 40 20 10 P3 8 4 2 1 PAPA2 P4 P5 ST ST ST ST ST ST6 P0

0 0 0 0 0 0 0 0 0 0 0

MINUTE | HOUR | DAY FOR ADJUSTMENT | CODE FOR CALLING | STOP OF WAVE INFORMATION

WEEKDAY

| 4W | 2W | 1W | WEEKDAY |
|---|---|---|---|
| 0 | 0 | 0 | SUN. |
| 0 | 0 | 1 | MON. |
| 0 | 1 | 0 | TUES. |
| 0 | 1 | 1 | WED. |
| 1 | 0 | 0 | THURS. |
| 1 | 0 | 1 | FRI. |
| 1 | 1 | 0 | SAT. |

PREPARATORY BIT (EXAMPLE USED AS DAYLIGHT SAVING TIME)

| SU1 | SU2 | DESCRIPTION |
|---|---|---|
| 0 | 0 | NO ALTERATION TO DAYLIGHT SAVING TIME IS MADE WITHIN 6 DAYS |
| 1 | 0 | ALTERATION TO DAYLIGHT SAVING TIME IS MADE WITHIN 6 DAYS |
| 0 | 1 | DAYLIGHT SAVING TIME IS DURING EXECUTION (NO ALTERATION FROM DAYLIGHT SAVING TIME TO NORMNAL TIME IS MADE WITHIN 6 DYAS) |
| 1 | 1 | DAYLIGHT SAVING TIME IS ENDED WITHIN 6 DAYS |

LEAP SECOND

| LS1 | LS2 | DESCRIPTION |
|---|---|---|
| 0 | 0 | NO LEAP SECOND EXISTS WITHIN 1 MONTH |
| 1 | 1 | (INSERTING) LEAP SECOND HAPPENS WITHIN 1 MONTH |
| 1 | 0 | (DELETING) LEAP SECOND HAPPENS WITHIN 1 MONTH |

PARITY (EVEN-NUMBER PARITY)
PA1: HOUR PARITY
PA2: MINUTE PARITY

STOP OF WAVE INFORMATION

| ST1 | ST2 | ST3 | DESCRIPTION |
|---|---|---|---|
| 0 | 0 | 0 | NO STOP OF WAVE IS SCHEDULED |
| 0 | 0 | 1 | STOP OF WAVE IS SCHEDULED WITHIN 7 DAYS |
| 0 | 1 | 0 | WITHIN 3 TO 6 DAYS |
| 0 | 1 | 1 | WITHIN 2 DAYS |
| 1 | 0 | 0 | WITHIN 24 HOURS |
| 1 | 0 | 1 | WITHIN 12 HOURS |
| 1 | 1 | 0 | WITHIN 2 HOURS |

| ST4 | DESCRIPTION |
|---|---|
| 0 | WAVE STOPPED ALL DAY LONG, OR NO STOP OF WAVE IS SCHEDULED |
| 1 | WAVE STOPPED ONLY IN THE DAYTIME |

| ST5 | ST6 | DESCRIPTION |
|---|---|---|
| 0 | 0 | NO STOP OF WAVE IS SCHEDULED |
| 0 | 1 | 7 DAYS OR LONGER, OR THE DURATION IS UNKNOWN |
| 1 | 0 | WITHIN 2 TO 6 DAYS |
| 1 | 1 | SHORTER THAN 2 DAYS |

Fig.4

| COUNTRY (REGION) NAME | | TIME DIFFERENCE VALUES WITH RESPECT TO UTC TIME |
|---|---|---|
| USA | FIRST REGION NY | −5 |
| | SECOND REGION CHI | −6 |
| | THIRD REGION COL | −7 |
| | FOURTH REGION LOS | −8 |
| DE | | +1 |
| GB | | 0 |
| JP | | +9 |
| CA | | |

Fig.18

| COUNTRY (REGION) NAME | | TIME DIFFERENCE VALUES WITH RESPECT TO JAPANESE STANDARD TIME |
|---|---|---|
| USA | FIRST REGION NY | −14 |
| | SECOND REGION CHI | −15 |
| | THIRD REGION COL | −16 |
| | FOURTH REGION LOS | −17 |
| DE | | −8 |
| GB | | −9 |
| JP | | 0 |
| CA | | |

RADIO CONTROLLED TIMEPIECE AND METHOD OF CONTROLLING THE SAME

TECHNICAL FIELD

The present invention relates to a radio controlled timepiece and, more specifically, to a radio controlled timepiece the use of which can be made in global districts and eliminates the necessity of performing the correcting operation for a local time in a prescribed area and/or the necessity of performing additional correcting operations for a local time depending upon whether of not the daylight saving time is executed in a prescribed area, thereby the timepiece is convenient to use for a user. Further, the present invention relates to a radio controlled timepiece which when receiving a standard radio wave including time information therein and automatically correcting the time based upon the time information thus has been received enables a setting operation for such time difference and a correcting operation of time to be easily performed.

BACKGROUND ART

A timepiece that is constructed so that, by receiving a radio wave including time information, the time may automatically be corrected to a correct time has already been put to practical use. Also, radio waves including time information that are used for radio wave correction, such as a "long wave" radio wave, have nowadays been transmitted in a plurality of countries such as Japan, the United States, Germany, Britain, etc.

However, regarding the above-described radio waves including time information, their frequency and transmission data format are different from each other.

On the other hand, the United States of America has four districts (regions) within her country each having a time difference that being different from each other. (For example, in Los Angels, a time that is obtained by subtracting 8 hours from the reception time (UTC time) is the local time (regional time) in that district; and in New York, a time that is obtained by subtracting 5 hours from the reception time (UTC time) is the local time (regional time) in that district.) In spite of this, the radio waves including time information and that are transmitted in U.S.A, is only one radio wave including the universal time information (UTC time)therein and which is transmitted only from the State of Colorado.

For this reason, after the user has received that radio wave, it is necessary for an user to separately perform adjusting operation for a time difference between the UTC time and the local time on the radio controlled timepiece side.

Also, in the United States, daylight saving time is introduced.

Therefore, after the user has received the above-described radio wave, it is necessary for the user to additionally judge at the time when the user has received the radio wave, whether or not daylight saving time has been put into effect and further adjust the above-described time difference once again.

On the other hand, in Japan, two types of radio waves including time information and each having frequency being different from each other, are transmitted, in one region Accordingly, in a case when an user of the timepiece moves from one country to another different country with a radio controlled timepiece that is equipped with a reception system that is able to receive a plurality of radio waves including time information each being different from each other and each being uniquely to the respective country, performing a lot of complex operations become needed.

For example, in a case when an user moves between the United States and Japan, conventionally, it is necessary for the user to perform time setting operation by judging in which time zone the user is staying now (for example, by judging whether the user is in Japan, or Los Angels, or in New York)

In addition thereto, with linking this zone setting operation, a name of a country where the reception is made and an radio wave that is to be received in that country, are selected and fixed (note that, when Japan is selected, only Japanese radio waves are received.).

In addition, in a case when the radio controlled timepiece is used in a country where daylight saving time is carried out, a setting operation for the daylight saving time becomes separately needed. (Although the daylight saving time can also be corrected by receiving the relevant radio wave, when the reception is impossible and manual setting is needed, the setting operation for daylight saving time becomes separately needed in addition to the setting operation for the time zone.)

Therefore, for example, in a case when an user has moved from Japan to the United States of America where the daylight saving time is carried out, two separate operations of performing the setting operation for a zone plus the setting operation for the daylight saving time become needed. So the user feels inconvenience in doing so.

On the other hand, in a Japanese official gazette of Japanese Patent No. 3868465, there is described a method of performing an automatic correction of the displayed time of a timepiece using a time code signal that is transmitted through an radio wave used for a radio receiver. More specifically, in order to automatically correct the time information of a movable timepiece, it is described that more than one frequencies of radio waves with which a time signal is transmitted, are previously registered with the respective zone information and in a destination area where the timepiece has been moved, an operation for correcting time is performed using the corresponding frequency that was registered in the respective destination area.

Also, in a Japanese official gazette of Japanese unexamined Patent publication (KOKAI) No. Hei-5-19071, there is described a timepiece that displays a universal time. In more detail, there is described a timepiece that is constructed so that a universal time can be calculated from local standard time information and a time difference information between that time information and that universal time and there may be displayed this calculated time.

However, regarding the above-described prior arts, any of them doesn't disclose a construction which, in a globalized radio controlled timepiece, enables the user simply to perform the time difference adjustment that includes a time difference based on the daylight saving time being executed when the user moves.

On the other hand, in a radio controlled timepiece, as described above, that receives a standard radio wave including time information with a minimized antenna and automatically performs time correction, although it is possible to correctly display the time information included in the standard radio wave that has been received, such function has also aspects of inconvenience as well. For example, even when, in order for the user of a radio controlled timepiece to obtain some advanced margin to his scheduled time, the user wishes to try to display time with giving some prescribed advanced time from the standard time that received, this was followed by the following inconvenience. Namely, in a radio controlled timepiece, since when a standard radio wave has been received, the time of the timepiece is automatically corrected to the standard time that has been received, the user has a difficulty of displaying time with advancing with the prescribed margin of time relatively to the standard time or delaying in the same way.

To solve the above-described points of problem, as illustrated in, for example, Japanese official gazette of Japanese un-examined Patent Publication (KOKAI) No. 2001-13280 or Japanese official gazette of Japanese un-examined Patent publication (KOKAI) No. Hei-4-83196, a timepiece has been proposed which comprises a time information reception means that receives a radio wave including time information, an input means that inputs a time difference information showing a difference between time information that has been received and time information that is displayed, with one minute as an units a storage means that stores the time difference information, and a time correction means that corrects the displayed time information according to the time difference information.

According to the timepiece or information apparatus that is disclosed in each of the above-described known techniques, it is possible to advance or delay the time that is being displayed relatively to the time information that has been received, along the user's intention.

Therefore, not only does it have a high reliability on the display of time but it is also possible to arbitrarily display the time that the user wants to display. Therefore, the user can use it as a timepiece that is easy to use.

However, in the above-described timepiece or information apparatus, since the setting of the time difference relative to the time information is performed with an unit of one minute, in a case when the inputting operation for the time difference information is carried out with an unit of one minute, it is certainly possible to input this information with a relatively simpler manner. However, in a case when the time difference information exceeds an hour, the number of times of the inputting operations becomes increased, resulting in the operation becoming very troublesome. Especially, in a case when a person who uses the timepiece has moved, within an area where a standard radio wave is used, from one country or region to another country or region each having the respective time difference being different from each other, there arises the necessity for correcting the time to the standard time as used in that country or region to which the user moved. However, since the minimum unit of time in which a time difference changes is usually one hour, when the time difference information is input, it is necessary to input the time difference information at least for exceeding one hour.

Therefore, an inputting operation for that information with an unit of one minute, makes this inputting operation troublesome, resulting in causing operating efficiency of the timepiece to have significant problem.

Also, in a case when it is unable to receive a standard radio wave including time information, it is necessary to manually perform the time correction. However, in the timepiece proposed as described above, because no consideration is taken to the time correction in a case when it is unable to receive a standard radio wave including time information, if, for example, no reception of a relevant standard radio wave could be made by any reason, it becomes possible that the timepiece will be unable to perform a function as a timepiece. This shows that this timepiece includes a problem over its basic function.

An object of the invention is to provide a radio controlled timepiece that eliminates the above-described drawbacks in the past radio controlled timepiece and that, in a case when the user who uses that radio controlled timepiece moves between countries or regions each having the respective time difference being different from each other, eliminates the necessity of the user separately performing two different operations for correcting the time difference existing between two of those countries of regions and for correcting the time difference based on the daylight saving time as executed, and thereby enables to complete all necessary the time-difference correction or adjustment with one radio wave operation.

Another object of the invention is to provide a radio controlled timepiece that, in a case when the setting operation for the time difference is performed in connection with the user's moving from one country or region to another where the time difference is different from each other, enables for the user to perform the setting operation easily and further, even in a case when the user is unable to receive a standard radio wave, enables him to simply perform correction of the time information of his timepiece with his manual operation so as to provide a radio controlled timepiece having high operating efficiency and excellent reliability.

DISCLOSURE OF THE INVENTION

To attain the above object, the invention adopts the basic technical construction that follows. A first aspect of the present invention is a radio controlled timepiece, which comprising a reference signal generating means that outputs a reference signal, a time keeping means that outputs time keeping information based upon the reference signal, a display means that displays time information based upon the time keeping information, and a receiving means that receives a standard radio wave having reference time information, whereby output time information output from the time keeping means can be corrected based upon the reception signal output from the reception means, and further wherein the radio controlled timepiece comprising an offset time difference information storage means that stores an offset time difference formed between a region where the reference time information is formed and a region where the standard radio wave has been received, a daylight saving time information storage means that stores therein information whether or not a daylight saving time is being executed in the region where the standard radio wave has been received and a local standard time information forming means that executes an operational processing for the reference time information of the standard radio wave that has been received in a particular region with utilizing at least one of the offset time difference information with respect to the reference time information corresponding to the particular region and the daylight saving time information used in the particular region, so as to form the local standard time information in the particular region.

A radio controlled timepiece according to the present invention, since it is adopting the technical features that have been described above, is constructed in the way that, in a case when the user who uses this radio controlled timepiece moves among a plurality of countries or moves among a plurality of regions each having the respective time difference being different from each other, it enables to receive a predetermined radio wave by automatically discriminating the country where the user existing, without causing the user to select the name of the country in which the user wishes to receive radio wave. Simultaneously, the timepiece according to the present invention enables to display a correct local time corresponding to the daylight saving time in a certain local area, simply by setting a local time in an area to which the user has moved, irrespective of whether or not the daylight saving time is executed in the country or region that he has moved.

In addition, that timepiece further enables to always display the correct local time corresponding to the daylight saving time in the certain local area, at every time when the radio wave is received thereafter.

Of course, even when the user has stayed in the U.S.A. for a long time and a transition has occurred from the daylight saving time season to the winter time (standard time) (or vice versa), the timepiece according to the present invention enables to automatically perform such changeover by the reception of the radio wave.

Also, in the present invention, the radio controlled timepiece is constructed so that it can receive the radio waves of all countries without fixing the reception station by setting operation done by the user.

BRIEF DESCRIPTION OF THE DRAWINGS

FIG. 1 is a block diagram illustrating the construction of a concrete example of A radio controlled timepiece according to the present invention;

FIG. 2 illustrates an example of data structure of the standard radio wave that is used in the present invention;

FIG. 4 is a view illustrating an example of the time difference data, calculated country-uniquely or compared inter-regionally, that is stored in offset time difference information storage means in the present invention;

FIG. 18 is a view illustrating an example of the time difference data, calculated country-uniquely or compared inter-regionally, in a case when the reference time in Japan is a Japanese standard time, is stored in the offset time difference information storage means in the present invention.

BEST MODE FOR CARRYING OUT THE INVENTION

Figure 3:
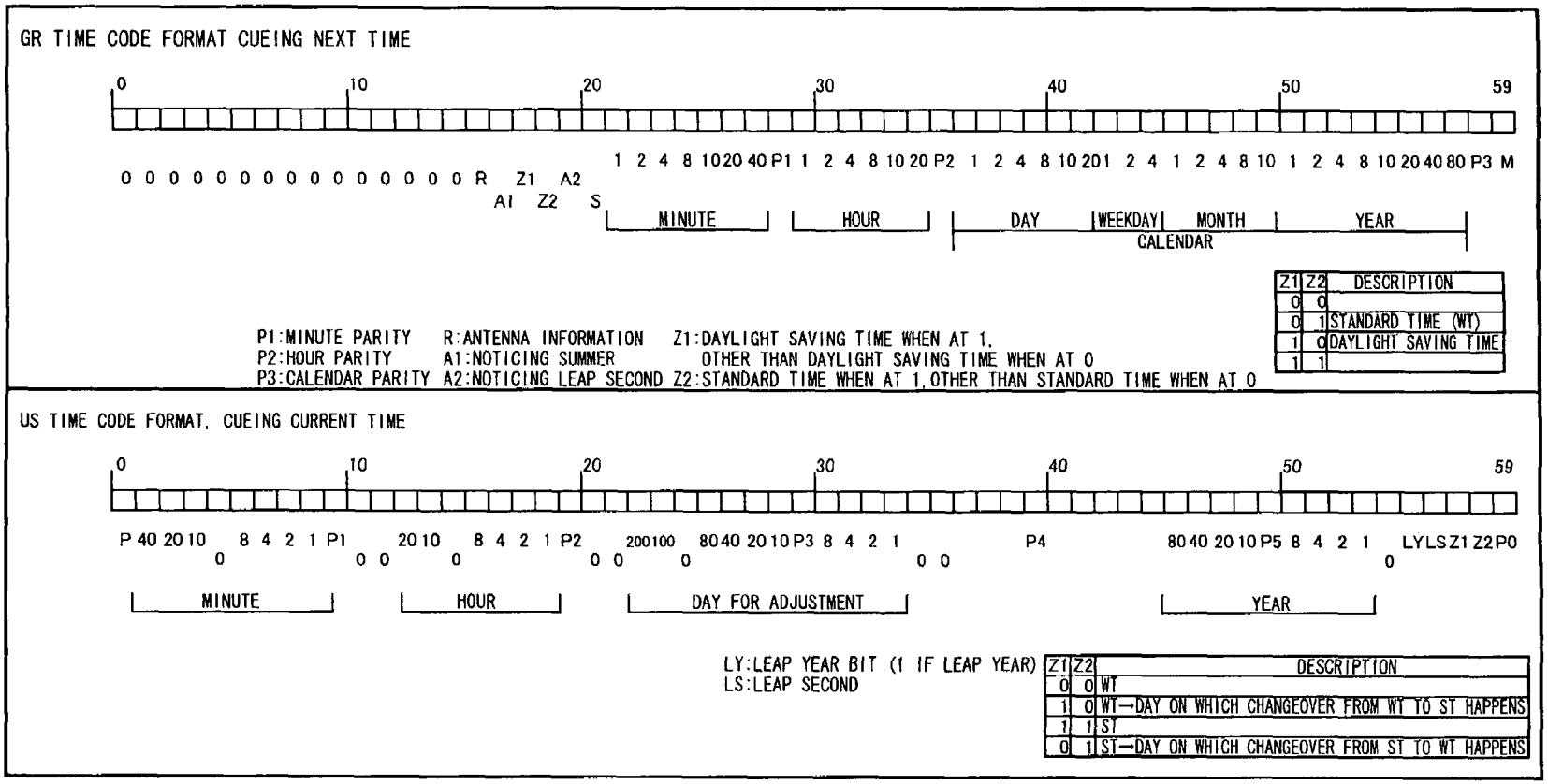
FIG. 3 illustrates an example of data structure of the standard radio wave that is used in the present invention.

The construction of a specific embodiment of a radio controlled timepiece according to the present invention will hereafter be explained in detail with reference to the accompanying drawings.

Namely, FIG. 1 is a view illustrating the construction of one specific embodiment of a radio controlled timepiece 1 according to the present invention.

FIG. 1 illustrates a radio controlled timepiece 1 which comprising a reference signal generating means 2 that outputs a reference signal, a time keeping means 5 that outputs time keeping information based upon the reference signal, a display means 6 that displays time information based upon the time keeping information, and a receiving means 7 having an antenna 17 and that receives a standard radio wave having reference time information, whereby output time information output from the time keeping means 5 can be corrected based upon the reception signal output from the reception means 7, and further wherein the radio controlled timepiece 1 comprising an offset time difference information storage means 8 that stores an offset time difference formed between a specific country or a specific region where the reference time information is formed and a specific country or a specific region where the standard radio wave has been received, a daylight saving time information storage means 9 that stores therein information whether or not a daylight saving time is being executed in a specific country or a specific region where the standard radio wave has been received and a local standard time information forming means 10 that executes an operational processing for the reference time information of the standard radio wave that has been received in a specific country or a specific region with utilizing at least one of the offset time difference information with respect to the reference time information corresponding to the specific country or the specific region and the daylight saving time information used in the specific country or the specific region, so as to form the local standard time information in the particular region.

Also, a radio controlled timepiece 1 of the present invention may be an analog type wrist timepiece or a digital type wrist timepiece.

The term "region" in the present invention may be the one that indicates an area that has been understood at a country level and the one that indicates a partial area within one country or an area that includes more than one country, which is collected into one body.

The reference signal generating means 2 of a radio controlled timepiece 1 according to the present invention preferably further comprising an oscillator circuit 3 and a frequency divider circuit 4.

In addition, a radio controlled timepiece 1 according to the present invention is provided with a reception-starting means 12 that is connected to the reception circuit 7 in order for a radio controlled timepiece 1 to start receiving a prescribed standard radio wave. The reception-starting means 12 is connected to a suitable switch means 11 that enables the user to perform his operation with respect to the timepiece 1.

Also, although not illustrated, when a prescribed point of time is reached, a reception start signal may be output from the time keeping means 5 to the reception-starting means 12.

Also, in A radio controlled timepiece 1 according to the present invention, it is preferable that it have at least one of decoder circuit 13 that decodes the radio wave that it has received through the intermediary of the reception circuit 7 to extract various kinds of information such as time information, country information, and daylight saving time information, a reference time information storage means 16, time difference correction history information storage means 15, received radio wave belonging country name storage 14, and radio wave reception time storage means 18.

On the other hand, to the above-described local standard time information forming means 10, there is connected the above-described offset time difference information storage means 8 and the daylight saving time information storage means 9.

Simultaneously, to the local standard time information forming means 10, there is connected a software storage means 19 that has stored therein a software program for executing a general time difference correction processing operation including a time difference correction with respect to the daylight saving time.

Of course, without providing the software storage means 19, the local standard time information forming means 10 as a whole may be constructed using a logical calculation circuit.

And, the local standard time information forming means 10 is constructed using a suitable processing circuit, the output of which is connected to the time keeping means 5.

Incidentally, in the present invention, as later described in the specification, there is a case when time difference correction processing with respect to a radio controlled timepiece 1 is executed by the user's manual operation, and, for allowing to do such operation, the output of the switch means 11 is also input to the offset time difference information storage means 8.

Incidentally, in this embodiment, although starting the reception by a manual operation based on using the switch means 11 has been illustrated using FIG. 1, as an another aspect for starting the reception, a regular reception at a fixed time, for example, the reception is started when the time keeping means 5 reaches a prescribed time, may be adopted (not illustrated).

As the reference time information used for time correction that is used in the present invention, a universal standard time information (UTC time information) is popular, but the invention is not limited thereto. In the present invention, any type of time information may be used as long as it can be globally used as a standard time information.

Meanwhile, as a standard radio wave including the reference time information that is now already used generally for time correction, as far as Japan is concerned, there are two types that are transmitted from two places, one type of standard radio wave being the one having a frequency of 40 kHz (hereinafter called "JJY 40") that is transmitted from the Prefecture of Fukushima and the other type of standard radio wave being the one having a frequency of 60 kHz (hereinafter called "JJY 60") that is being transmitted from the District of Kyushu.

On the other hand, in the United States of America, as stated before, there is used a standard radio wave that is transmitted from the State of Colorado (hereinafter called "WWVB").

Also, in Germany, there is used a standard radio wave that is transmitted from Frankfurt and that is called "DCF 77" while in Great Britain there is used a standard radio wave that is transmitted from Rugby and that is called "MSF".

These respective radio waves are different from one another in frequency. However, as illustrated in FIG. 2, that radio wave has a data format that is constructed of 60 bits that correspond to a 60-second length of time with a 1 bit corresponding to a 1 second. Also, a data format of one radio wave is somewhat different from that of other radio wave. However, calendar information, time information such as hour, minute, and second, and the daylight saving time information, etc., are commonly included in that data format.

FIG. 2 illustrates an example of the data format of the standard radio wave that is used in Japan; FIG. 3(A) illustrates an example of the data format of the standard radio wave that is used in Germany; and FIG. 3(B) illustrates an example of the data format of the standard radio wave that is used in the United States of America.

Incidentally, the reference time information that is included in the above-described standard radio wave that is being transmitted in the United States of America is exactly the universal standard time information (UTC time information)

However, in Japan and in Germany, a local standard time information that prevails in a particular (prescribed) area, is used, i.e., it is exactly the local time information of the area, itself.

For example, each one of the reference time information that is included in the above-described two types of standard radio waves which are transmitted within Japan, substantially represents then Japanese standard time information (namely, represent exactly the Japanese local standard time information) that is obtained by adding a time-difference of 9 hours to the universal standard time information (UTC time information).

Accordingly, by receiving the standard radio wave that is used in the present invention, not only it is possible to confirm the name of a country that is transmitting the standard radio wave that is received but it is also possible to obtain the daylight saving time information in that country (although in Japan the daylight saving time is currently not used, as illustrated in FIG. 2, this information is prepared as a preparatory bit).

Also, the waveform of the transmission radio waves used in one country is different from that used in other country and, therefore, the selection of country can be performed by checking the frequency or the frequency and the transmission waveform".

Namely, whether the first standard radio wave has been received or the second standard radio wave has been received is recognized, thereby the selection of the country or the region can be performed.

On the other hand, in a case when in correctly setting a local standard time information in each of the respective countries or regions by using a radio controlled timepiece according to the present invention, it is required to use a common reference time information. However, in the present invention, as the reference time information, there is used the universal standard time information (UTC time information) that was stated previously. Accordingly, in this embodiment, even when the standard radio wave has been received either in Japan or in the United States of America, the timepiece has an internal time data consisting of the UTC time.

Accordingly, for example, in a case when the radio controlled timepiece is used in the United States, in the reference time information storage means 16, for example, the UTC time, that has directly been received is stored. However, in Japan, in the reference time information storage means 16, the UTC time information that is obtained by subtracting a relevant time difference of 9 hours from the reference time information that has been received so as to convert the reference time information into the UTC time.

Accordingly, in the above-described specific example, all the calculation processing associated with the correction of time that will be described later are executed using the UTC time information as the base therefor.

However, it is also possible to use a reference time information as a local standard time information in a particular region and thereby to execute the calculation processing by using that reference time information and this technical feature can also be included in the present invention.

Also, in a case when the Japanese standard radio wave (JJY 40 or JJY 60) is received, in the offset time difference information storage means 8, a time difference with respect to the UTC time, i.e. a time difference of +9 hours is set. Also, in a case when the German standard radio wave (DCF 77) is received, in the offset time difference information storage means 8, a time difference of +1 hour is set. As a result, the information obtained from the above-described reference time information storage means 16, the offset time difference information storage means 8, and the daylight saving time information storage means 9, a relevant local standard time can be generated in the local standard time information forming means 10.

Since Japanese and German standard radio waves are the Japanese and German standard time information, respectively, as described previously, there is no need to additionally execute a calculation processing to determine the local standard time.

However, in, for example, a case when a radio controlled timepiece which is able to receive the radio wave in both Japan and the United States is used, the following problem arises unless the following prescribed time difference is set.

Note that, it is assumed that when the user allowed the timepiece to receive the radio wave in Japan, and then he has moved to the United States, followed by correcting the time to the local time in the U.S.A., (for example New York (N.Y.) time, i.e., the UTC time −5 hours), and thereafter he has received the United States of America's standard radio wave.

In this case, unless a predetermined time difference information with respect to the reference time information (UTC time) was set in the offset time difference information storage means 8, when the user received Japanese standard radio wave in Japan, the problem arises in that when the user has received the radio wave in the U.S.A., the time information as displayed will be shifted from the N.Y. time that the user wants to display.

Therefore, in a case when the user performs time correction by his manual operation that uses the switch means 11, it is necessary to store in the time difference information in the offset time different information storage means 8, not a time difference information of −14 hours that is the time difference between Japan and New York but a time difference information saying that "alter the same from +9 hours to −5 hours". If doing so, even the above-described way of using doesn't cause the occurrence of a shift in time.

Although the embodiment has been described about the relationship between Japan and the United States of America, the same thing is also applicable to the radio controlled timepiece which can receive three radio waves used in Japan, the United States, and Germany.

That is to say, in a case when a first standard radio wave is set for Japan and a second standard radio wave is set for Germany, it is needed that the first time difference data (+9 hours) and the second time difference data (+1 hour) should be set in the offset time difference information storage means 8.

Namely, in the specific embodiment of the present invention, a radio controlled timepiece is configured so that the reception means is provided with an automatic selective-reception control means that performs a control of enabling automatic selective reception from between the first standard radio wave including the first reference time information and the second standard radio wave including the second reference time information and in a case when it has been recognized that the first standard radio wave has been received, the first time difference data is set in the offset time difference information storage means; and in a case when it has been recognized that the second standard radio wave has been received, the second time difference data is set in the offset time difference information storage means.

Also, in the offset time difference information storage means 8 used in the present invention, it is preferable that a table as illustrated in FIG. 4 be included therein that shows the names of relevant countries and the time difference information between the time information of the relevant countries and the UTC time information in the way that both of them are in correspondence with each other.

And, in the present invention, in a case when in correcting time in a particular country or a particular time difference region by using a radio controlled timepiece 1, it is arranged as a first step to recognize that which country or which time difference region the standard radio wave that has been received belongs to. Then, based upon the information thus been recognized, the information of the country or the time difference region is stored in the above-described received radio wave belonging country name storage means 14. Then, after reading out and making a decision of whether or not the radio controlled timepiece 1 is in country or a time difference region to which the radio wave which is receiving now belongs.

And finally, it is thereby possible to read out and determine the time difference information corresponding to the table from the country information or the time-difference region information.

On the other hand, as described above, in the United States of America, despite the fact that only one standard radio wave including the UTC time information that is one reference time information is transmitted, the interior of the United States of America is divided into four regions, in each of which a different time difference is set.

Accordingly, regarding the United States of America, the local standard time information (UTC time −7 hours) in one region, for example, a region including the State of Colorado can be automatically set but, regarding the other regions, it is difficult to automatically set the local standard time information. In addition, automatically correcting the time difference when the user has moved between the regions within the United States of America also is impossible to perform. Therefore, as far as concerning that portion, the user needs to correct the same by his or her manual operation.

For this reason, for facilitating the user's operation, a table, such as that illustrated in FIG. 4 regarding the United States of America, in that there is defined the time difference information between, for example, the following four regions: a first region including New York (N.Y.), a second region including Chicago (CHI), a third region including the State of Colorado (CO), and a four region including Los Angels (LOS), is provided in the offset time difference information storage means 8. Thereby, the user manually does his time correction to set the local standard time information in a prescribed region.

Of course, the above-described operation can also be automated by storing in suitable storage means the data such as illustrated in FIG. 4 and using suitable software that has been prepared so as to cause a computer to execute that operation.

In that case, for example, the name of a region where the user previously performed time correction and the name of a region where he is about to perform the correction this time are designated through the switch means 11, after which the calculation processing for the above-described correction operation is executed by that computer.

Furthermore, the daylight saving time information storage means 9 that is used in the present invention stores therein daylight saving time information that has been taken out from the standard radio wave that has been received, for example, daylight saving time information that has an radio wave format illustrated in FIG. 2 or 3.

By doing so, it is arranged, in advance, to be able to confirm information on whether the daylight saving time is being executed in a country or region where the user is currently located.

As explained later, in a particular country or a particular region a local reference time information is first obtained by adding a predetermined time difference information to or subtracting the same from the reference time information included in the reference radio wave which the user has received.

Then the local reference time information is further used so that a correcting time difference information obtained from the daylight saving time information as used in the predetermined country or the predetermined region is read out from the daylight saving time information storing means 9, and the time difference of one hour is added to or subtracted from the local reference time information.

Also, regarding the daylight saving time information, it is preferable that the daylight saving time information should be executed with a correction processing in an association with the daylight saving time information stored that is obtained when the reception was previously made and the daylight saving time information that has been obtained when reception has been made this time.

Also, in the radio wave reception time storage means 18 of the present invention, it is stored beforehand, for example, at what time in a particular country or particular region the user performed reception operation for the standard radio wave.

By doing so, it is possible to use the stored information for the purpose of, using the daylight saving time information included in the standard radio wave such as that illustrated in FIG. 2 or 3, judging the relationship between the reception day and the day in which the daylight saving time is executed and thereby estimating a timing for performing later the time difference adjusting operation. Or, in a case when, after time correction has been once performed, the day that was determined beforehand has passed, it is possible to use that information for informing the user of a timing for reception of the standard radio wave for performing re-adjustment of time.

On the other hand, the time difference correction history storage means 15 that is used in the present invention, stores therein information on whether or not when the user performed time correction operation in the past, an operation for correcting the time difference information was performed. The information that is to be stored includes information in the case when the user manually performed time difference correction operation.

That information becomes effective in a case when the user performs the above-described correction associated with the daylight saving time.

This time-difference correction history information preferably includes an operation history that was performed at least once in the past.

Regarding the history information, in the offset time difference correcting information forming means 20, for example, as described later, information for correcting time difference alters according to the judgment whether or not the time at which the previous time correction operation was performed, was during when the daylight saving time being executed and according to the judgment whether or not the daylight saving time is now executed, using the daylight saving time information that has been obtained by receiving operation that was made after the time correction operation has been performed this time.

Using that information for correcting time difference, in the particular country or the particular region, processing operation for correcting that local standard time information is executed automatically or manually.

Namely, another specific embodiment of a radio controlled timepiece according to the present invention is a radio controlled timepiece that has the time difference correction history information storage means that stores information on whether or not the user has manually corrected his timepiece time and when the standard radio wave is received, the offset time difference correction information is corrected, taking the information of the time difference correction history storage means into account, from the daylight saving time information that was received when the previous standard radio wave was received and the daylight saving time information that has been obtained when the standard radio wave has been received this time.

The local standard time information that is output from the above-described local standard time information forming means 10 of the present invention may be constructed in the way that it is directly displayed on the display means 6, or in the way that it is displayed on the display means 6 through the above-described time keeping means 5.

Incidentally, as referred to as above, in Japan, the standard radio wave already represents the Japanese standard time that is used as the reference time information. Therefore, in a case when that standard radio wave is a local standard time information in that particular region, the local standard time information forming means 10 preferably is constructed in the way that with respect to the local standard time information calculation processing is executed using the daylight saving time information in that particular region.

Furthermore, it is also preferable that the local standard time information forming means 10 be constructed in the way that, with respect to the local standard time information, with using the offset time difference information in the particular region, for example, a universal standard time information (UTC time) is calculated as the reference time information corresponding to the local standard time information and that calculated result is stored in the reference time information storage means 16.

Explaining using German standard radio wave as an example, in a case when the daylight saving time is not executed (in case of during the German standard time), in the reference time information storage means 16, the UTC time information that has been obtained by subtracting the relevant time difference of 1 hour from the reference time information that has been received so as to convert this information into the UTC time, is stored.

On the other hand, in a case when the daylight saving time is being executed (in case of during the daylight saving time), because the information of the time of the daylight saving time as well as the information of that the daylight saving time is now executed in Germany is transmitted, in the reference time information storage means 16, the UTC time information that has been obtained by subtracting the time difference of 1 hour from the reference time information that has been received and further subtracting 1 hour therefrom with utilizing the daylight saving time information, namely by subtracting 2 hours in total therefrom so as to convert this information into the UTC time, is stored.

On the other hand, the reception means 7 that is used in the present invention preferably is provided with therein an automatic selective-reception control means that performs a control for enabling to automatically and selectively receive any one of a plurality of standard radio waves and preferably is constructed in the way that, in a case when the standard radio wave to be received has been altered, as described above, at least either the offset time difference information in a particular country or a particular region or the daylight saving time information in a particular country or a particular region is set again.

Namely, a specific embodiment of the present invention is the one that is constructed in the way that the reception means in a radio controlled timepiece is provided with a received radio wave belonging country name storage means that stores therein the country information that has been recognized by the standard radio wave that has been received via an automatic selective-reception control means; and, in a case when the standard radio wave to be received has been altered, at least either one of the offset time difference information of the offset time difference information storage means in the particular region and the daylight saving time information of the daylight saving time information storage means in the particular region is set again.

Also, as in the United States of America, in a case when more than one sub-region (namely, four sub-regions) is provided each having the respective offset time difference information that is different from each other, with respect to the national reference time information used as that of a country, for example, the universal standard time information (UTC time information −7 hours), the national reference time information is preferably generated, for example, in such a way that one sub-region (for example a third region including the State of Colorado) has been selected first from that plurality of sub-regions, and then with respect to the sub-region, calculation processing is automatically executed by applying either one, or both, of the offset time difference information with respect to the reference time information corresponding to that particular region, (e.g. the universal standard time information (UTC time information) −7 hours) and the daylight saving time information in that particular region, to the UTC time information to thereby form that local standard time information.

In a case other than that case, it is preferable that the timepiece be constructed in the way that it forms a local standard time information of a particular sub-region and regarding the local standard time information in other sub-regions, it is formed by setting the time difference between each two of the sub-regions through the user's manual operation by using the time difference information illustrated in, for example, FIG. 4.

Hereinafter, a concrete example of a time correction method for a local standard time information in a particular or a particular region, which uses a radio controlled timepiece 1 according to the present invention will be explained in detail with reference to the flow charts of FIGS. 6 and 7.

Figure 6:
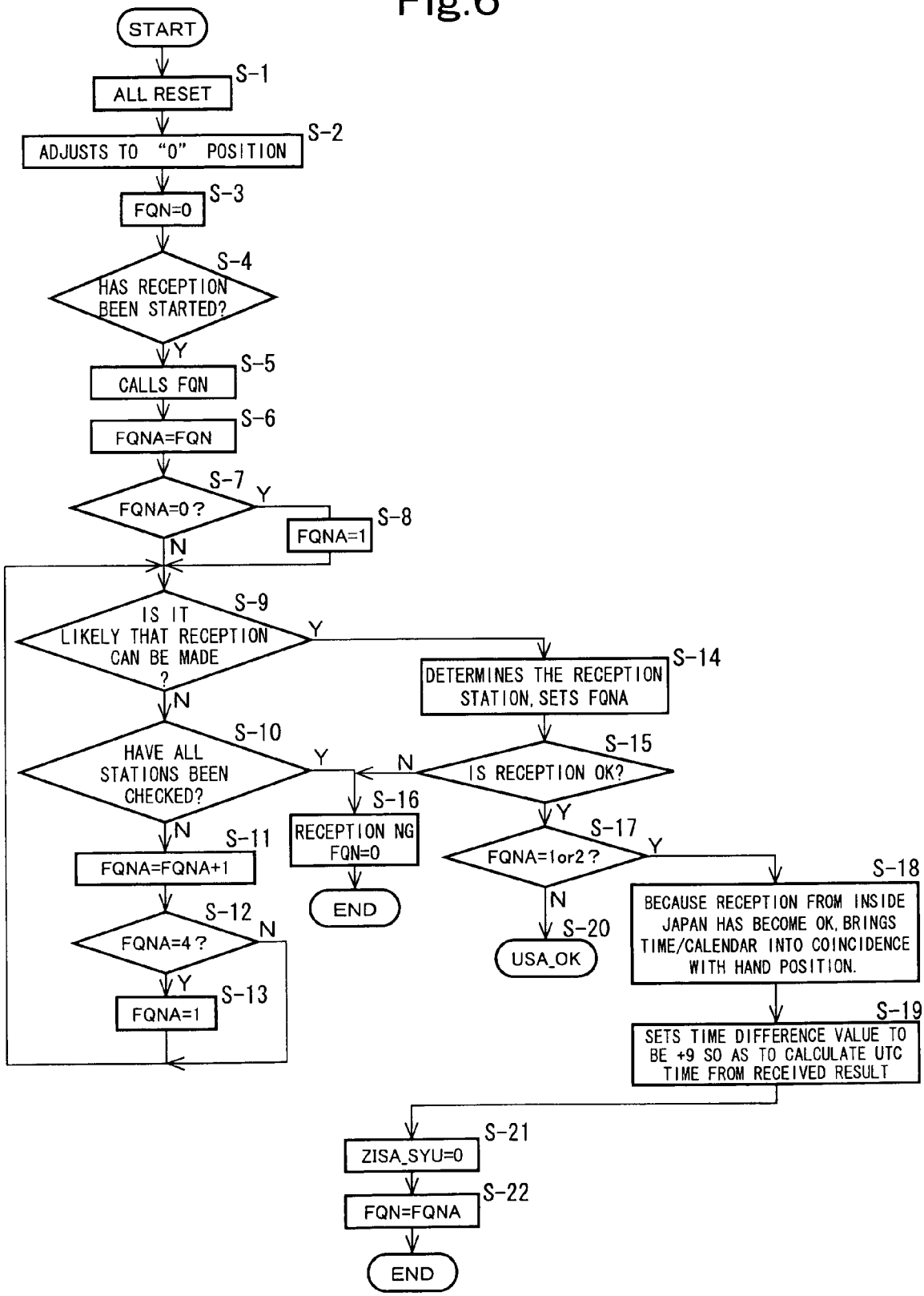
FIG. 6 is a flow chart illustrating an operation procedure for executing a time correction method that uses A radio controlled timepiece according to the present invention.
Figure 7:
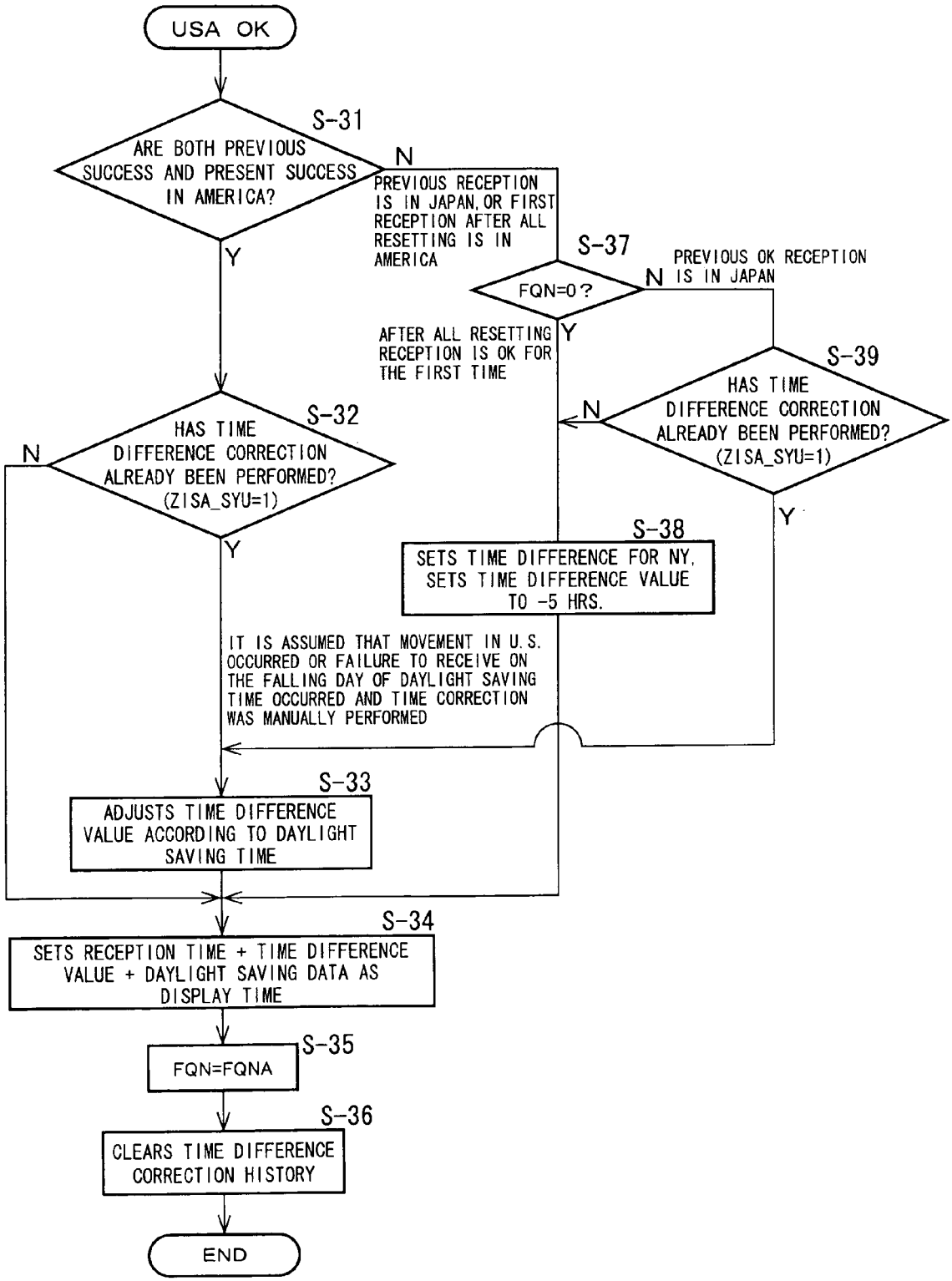
FIG. 7 is a flow chart illustrating an operation procedure for executing a time correction method that uses A radio controlled timepiece according to the present invention.

Namely, while the illustrations made in FIGS. 6 and 7 explain using as an example a case where A radio controlled timepiece 1 of the present invention is used between Japan and the United States, the present invention is not specifically limited to that concrete example. That is, needless to say, it is also possible to use the timepiece in a global way while the user moves between the United States and Germany, between Japan and Germany, or further the user optionally moves around all over those countries.

The flow chart of FIG. 6 is illustrated for explaining an example of an operation procedure that is executed when a radio controlled timepiece is used, especially in Japan.

After start, in a step (S-1), a resetting operation is performed, and, in a step (S-2), for example, in a case when A radio controlled timepiece 1 that is used is an analog type timepiece, an operation for adjusting the "0" position is performed. In a step (S-3), the frequency information of a standard radio wave that is to be received is initialized to thereby set a code number for a reception station FQN to FQN=0 for future operations. Up to this step of operation are initial operations.

Thereafter, in a step (S-4), it is determined whether or not the user has operated the switch 11 of A radio controlled timepiece 1 and the time correction processing operation using a radio controlled timepiece 1 has thereby been started. If "NO", the step (S-4) is repeatedly executed while if "YES", the flow proceeds to a step (S-5), in which there is executed an operation of calling a reception station (JJY 40, JJY 60, or WWVB) for the standard radio wave that was previously received. The flow then proceeds to a step (S-6), in which the reception station FQN for the standard radio wave that was previously received is inserted into a prescribed buffer FQNA (FQNA=FQN).

Subsequently, the flow proceeds to a step (S-7), in which for determining whether or not, at the time of the previous reception operation, a prescribed standard radio wave could accurately be received, it is determined whether or not the reception station FQN for the standard radio wave that had been received is FQN=0.

Here, the determination of FQN=0 indicates that no reception has ever been able to be made after executing the resetting operation.

Therefore, if in the step (S-7) the determination is "YES", namely in a case in that no reception has ever been made after the resetting operation, the flow proceeds to a step (S-8), in which setting operation is performed to compulsively adjust the reception station for the standard radio wave that is to be received to JJY 40. Namely, setting operation to set FQNA=1 is performed and then the flow proceeds to a step (S-9), in which an operation for determining whether or not the standard radio wave from the JJY 40 that has been set can be received, is executed.

Here, when and before executing this flow chart, it is previously set, for example, that:

FQN=1:JJY 40

FQN=2:JJY 60

FQN=3:WWVB (the United States)

On the other hand, in a case when in the step (S-7) "NO" determination is made, namely in a case when in the previous reception operation a particular standard radio wave could have been received, the flow similarly proceeds to the step (S-9), in which there is executed an operation of determining whether or not the standard radio wave that could be received in the previous reception operation can also be received this time.

The determination in the above-described step (S-9) on whether or not the standard radio wave can be received, for example, by performing computer sampling, etc. on the electromotive voltage that generates on the antenna for receiving the standard radio wave that is about to be received, or a voltage level after amplifying that electromotive voltage, or a signal that has been demodulated.

In the step (S-9), if "NO" determination is made, namely in a case when it has been determined that the standard radio wave that has been designated is unable to be received, the flow proceeds to a step (S-10), in which it is determined whether all the standard radio waves have been checked, in other words, whether or not all radio wave output stations that output the standard radio waves each having a prescribed frequency, which are foreseen or anticipated, have been checked.

And, in a case when "YES" determination is made in the step (S-10), since it is determined that the standard radio waves is impossible to receive, the flow proceeds to a step (S-16), in which any reception operation is stopped.

On the other hand, in a case when "NO" determination is made in the step (S-10), the flow proceeds to a step (S-11), in which, for receiving another standard radio wave or for changing the transmission station that is transmitting a relevant standard radio wave, the value of the frequency code number (FQN) is incremented by 1 (FQNA=FQN +1). Then the flow proceeds to a step (S-12), in which it is determined whether or not the frequency code number of the standard radio wave that has newly been selected is a final code number.

Namely, it is determined that, by setting the standard radio wave having a frequency code number which has been incremented by one, as a target, and a re-checking operation for checking whether or not this standard radio wave can be received, is performed.

Since, at this stage, FQNA=1 is set in the step (S-8), i.e. the standard radio wave of JJY 40 is selected, FQNA=2 is set here, thereby a standard radio wave of JJY 60 is selected.

In this concrete example, in case of FQNA=1, as described above, the three kinds of standard radio wave are used as the objects that are to be received. Therefore, if FQNA=4, it results that all the frequencies, in other words, all the relevant transmission stations have being checked.

In a case when FQNA=2 or 3 in the step (S-7), even if it has been determined that FQNA=4, this doesn't mean that all the transmission stations have been checked.

Therefore, the flow proceeds to a step (S-13), in which FQNA=1 is set. Thereafter, it is arranged that the stations corresponding to FQNA=1 or FQNA=2 are checked, thereby checking operation for all the stations will be finished.

Accordingly, in a case when "YES" is made in the step (S-12), the flow proceeds to the step (S-13), thereby the FQNA=1 is confirmed, so that the processing is returned to selecting operation for selecting the JJY 40 standard radio wave.

Also, in a case when "NO" determination is made in the step (S-12), the flow is returned to the step (S-9), whereby the above-described respective steps are repeatedly executed.

On the other hand, in a case when "YES" is made in the step (S-9), that is, it has been able to be confirmed that the standard radio wave that is planed to be received is in a state of being able to be received, the flow proceeds to a step (S-14), in which that reception station is determined and the FQNA is set accordingly.

Thereafter, the flow proceeds to a step (S-15), in which it is determined whether or not the receiving operation of the standard radio wave from that reception station is reliable.

If "NO", the flow returns to a step (S-16), in which the reception operation for that standard radio wave is stopped.

However if "YES", the flow proceeds to a step (S-17), in which it is determined whether or not the frequency code number FQNA of the standard radio wave that has been is either 1 or 2.

As described above, if the frequency code number FQNA of the standard radio wave that has been received is either 1 or 2, it is determined that that standard radio wave is the one that is being transmitted from a transmission station inside Japan. Therefore, using this standard radio wave, the local standard time information in Japan can be set to a correct time.

Conversely, in a case when the frequency code number FQNA of the standard radio wave that has been received is neither 1 nor 2, as described before it is understood that the standard radio wave that has been received is the one that is being transmitted from a transmission station within the United States of America (or from within Germany). Therefore, in that case, the flow proceeds to a step (S-20), then, alongside the flow chart illustrated in FIG. 7, the time correcting operation is transferred to inside the United States of America.

On the other hand, in a case when it has been determined in the step (S-17) that the standard radio wave that has been received is the one that is being transmitted from a transmission station inside Japan, the flow proceeds to a step (S-18), in which a time information, a calendar information, or hand position of the radio controlled timepiece 1 are corrected according to the reference time information thus received and the standard radio wave has, and the time information of the radio controlled timepiece 1 is brought into coincidence with that reference time information.

This operation is automatically performed, as the correction operation, according to a prescribed program by the local standard time information forming means 10 having a calculation processing function that A radio controlled timepiece 1 possesses.

Incidentally, in this concrete example, as described above, the standard radio wave used within Japan, unlike in the United States of America, doesn't use the UTC time information that is representatively used as one of the universal standard time information, but has as the time information the value of which is obtained by adding to the UTC time information the time difference information of 9 hours that is the time difference information that Japan has with respect to the UTC time information, per se. Therefore, it is possible to use this reference time information that the standard radio wave that has been received has, as the local reference time information in Japan, as it is, since it is in coincidence with the local standard radio wave in Japan.

Accordingly, it is not necessary to use a time difference correction routine, as executed in the United States and as illustrated in FIG. 3,which is used for calculating the local standard time information in the region or the country, by using the time difference information between a region where the reference time information is formed after reception and a region where a radio controlled timepiece 1 is currently located, with respect to the reference time information that the standard radio wave such has.

However, as described before, in A radio controlled timepiece 1 of the present invention, it is premised that relevant data is necessarily held in advance in the form of reference time information. Therefore, the flow proceeds to a step (S-19), in which, for converting the reference time information obtained from the received result into, for example, UTC time information, the value of 9 hours that is set as the time difference value is subtracted from that reference time information, to thereby calculate that UTC time information. Then, this UTC time information is stored in the reference time information storage means 16 for future use.

Thereafter, the flow proceeds to a step (S-21) to clear the time difference correction history, after which the flow proceeds to a step (S-22), in which the frequency code number of the standard radio wave that has been received is inserted as information for FQN. Updating processing is thereby executed to END.

Next, in a case when A radio controlled timepiece 1 according to the present invention has moved to the U.S., the flow chart of FIG. 7 is used as an example.

Incidentally, in the U.S., in a case when the standard radio wave that is transmitted from a transmitting station within the State of Colorado has been received, if the user does not take any time difference correction operation with respect to the UTC time that he has received, it is assumed that the timepiece is constructed like this. Namely, 5-hour subtraction is automatically performed (UTC −5 hrs.) and the timepiece displays the local standard time information in the region including New York.

Thereupon, in a case when the user has succeeded in receiving the standard radio wave in America, it is first determined in a step (S-31) whether or not both the previous reception and the reception that has been made this time were made in America (whether of not FQN=3).

In a case when "YES" is made in the step (S-31), namely in a case when both the previous reception and the present reception were made in America, the flow proceeds to a step (S-32), in which it is determined whether or not the time correction operation has already been performed by the user's manual operation.

This operation determines whether or not, for example, when the user has moved within America from one region to another where the time difference thereof is different from each other, the user has beforehand, performed time difference correction setting operation.

If "NO" is made in the step (S-32), the flow proceeds to a step (S-34), in which the reception time, time difference value, and the daylight saving time data is displayed.

On the other hand, if "YES" is made in the step (S-32), the flow proceeds to a step (S-33), in which from the daylight saving time conditions in the previous reception and that in the present reception, adjusting operation for adjusting the time difference, based on using the daylight saving time, is automatically performed according to, for example, the algorism that follows.

Namely, according to a change in the daylight saving time condition between the time when the previous receiving operation has been performed and the time the current receiving operation is performed, the time difference value will be varied from the time difference value which the radio controlled timepiece 1 currently has by adding thereto by +1 or 0 or by subtracting therefrom by −1.

| When previous reception is made | When present reception is made | Conditions for processing |
|---|---|---|
| 0 | 0 | No change is made in time difference value |
| 0 | 1 | Time difference value is made −1 |
| 1 | 1 | Time difference value is made +1 |
| 1 | 0 | No change is made in time difference value |

In the algorism above, the "0" represents the standard time, and the "1" represents the daylight saving time's time.

Subsequently, if "YES" is made in this step (S-32) and, in addition, after a step (S-33) has been executed, as well, the flow proceeds to a step (S-34), in which the time difference value that is necessary for the UTC time that has been received and the local standard time information that has been formed by performing addition or subtraction processing on the daylight saving time data are displayed in the display means. Then, the flow proceeds to a step (S-35), in which the station that transmits the standard radio wave that has been received is stored in the prescribed storage means, to thereby execute updating processing. Then, the flow proceeds to a step (S-36), in which the time difference correction history is cleared to END.

Also, in a case when "NO" is made in the step (S-31), or "NO" is made in a step (S-39) as described later, a separate unit of processing is provided after the END of that flow chart.

Figure 5:
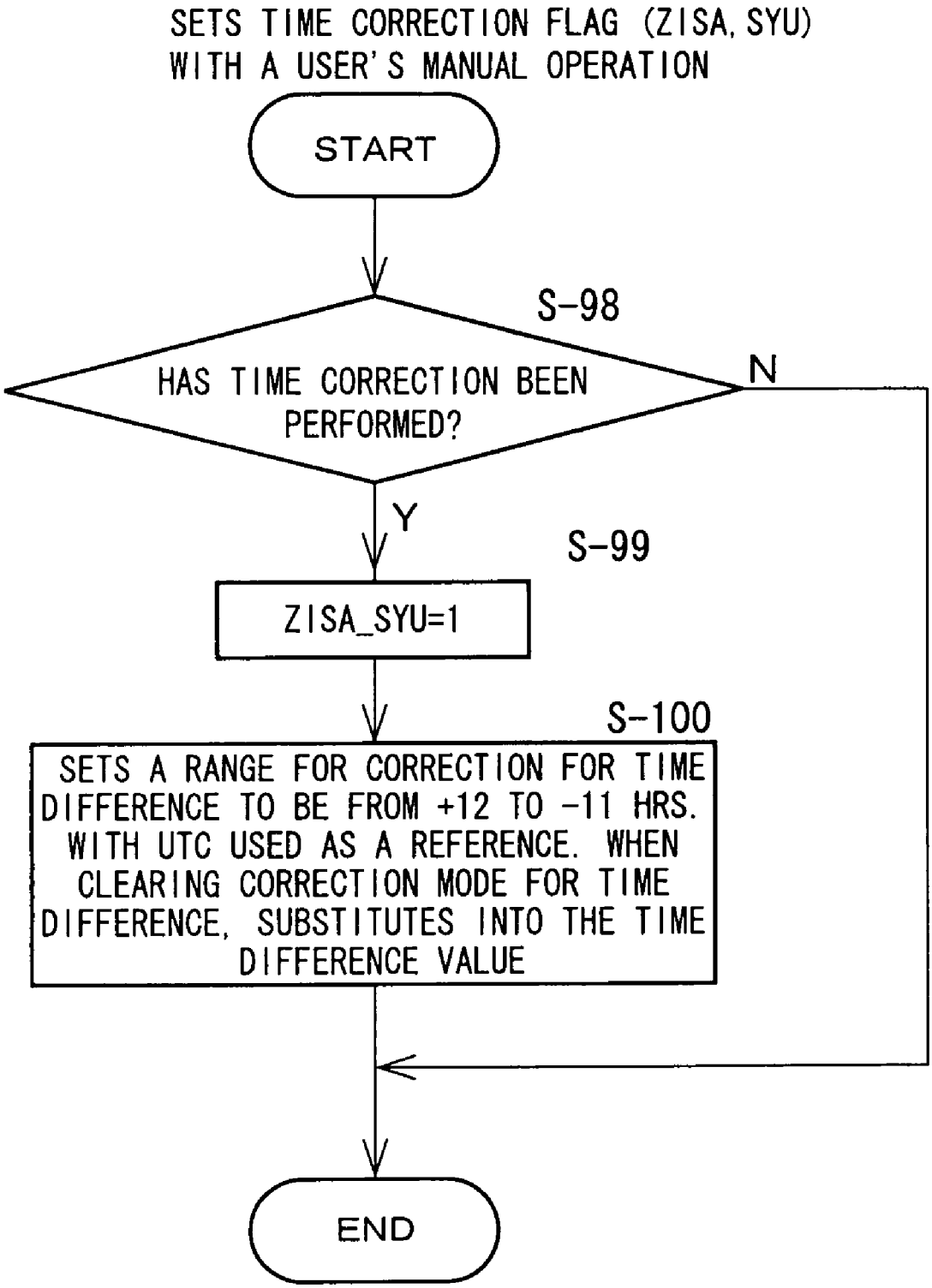
FIG. 5 is a flow chart illustrating an example of a time correction routine in the present invention.

And, it is necessary, as the occasion demands, to execute, using a routine such as that illustrated in FIG. 5 and in correspondence with the correction time difference portion exemplified in the part of the U.S. in FIG. 4, calculation processing for calculating the correct local standard time information in a relevant prescribed region, so that the time difference correcting operation manually performed by the user converts the display time displayed on the radio controlled timepiece to the local standard time of the region to which the user has moved.

Namely, it is necessary, as the occasion demands, to do so in order for the displayed time of A radio controlled timepiece to be made the local standard time in the place to which the user has moved as a result of his manual time difference correction operation.

On the other hand, in a case when "NO" is made in the step (S-31), that is, in a case when the previous reception is either in Japan or the first reception that the user succeeded in making after he had done resetting (ALL RESET), the flow proceeds to a step (S-37), in which it is determined whether or not FQN=0.

This operation, is understood that if the FQN number is 1 or 2 when the previous reception was made, this previous reception was made in Japan, and it is understood that if that FQN number is 0, the reception that has been made this time is the first reception that the user has succeeded in doing after resetting (ALL RESET).

Accordingly, in a case when "YES" is made in the step (S-37), it results that in the step (S-38) the determined data is set as the local standard time information in one of the regions that have been determined beforehand.

In this concrete example, for example, since that data is displayed as the local standard time information in the region (first region) including New York, a time difference of −5 hours is set.

Thereafter, the flow proceeds to a step (S-34), in which time for display is calculated.

On the other hand, in a case when "NO" is made in the step of (S-37), the flow proceeds to a step (S-39), in which it is determined whether or not before reception that has been made this time, time correction operation was performed with the user's manual operation.

For example, in a case when, when the user moves from Japan to America, he manually performed time correction or alteration for A radio controlled timepiece 1 according to the time information that was broadcast, or displayed, within the plane, so long as the user remains to stay in an area in the United States where the time to that he manually corrected or altered according to the time information that was broadcast, or displayed, within the plane is available, that time information can be used as it is. In this case, in addition, that time information is fed back to the offset time difference information or daylight saving time storage information after a standard radio wave has later been received, thereby a desired time display is realized.

Thereupon, in the step (S-39), it is determined whether or not the time difference correction operation that includes the manual operation that is performed by the user in the plane, has already been performed. If "NO", the flow proceeds to the step (S-38), after the execution of that the above-described respective steps are executed.

On the other hand, if "YES" in the step (S-39), the flow proceeds to the step (S-33), in which the adjusting operation for daylight saving time is performed, after which the above-described respective steps are executed.

The foregoing explanation has been given of the case where the reference time information is regarded as the UTC time, namely the time that is stored in the reference time storage means 16 is the UTC time. However, the invention is not limited thereto.

For example, even if Japanese standard time or German standard time is stored into the reference time information storage means, the same effect is obtained. In a case when using Japanese standard time as the reference time information, the regions and time difference values illustrated in FIG. 4 change into those illustrated in FIG. 18, while, on the other hand, the range for correction for time difference as shown in (S-100) of FIG. 5, becomes from +3 to −20.

Here, if attempting to explain about the flow chart of FIG. 5, after start, in a step (S-98), it is determined whether or not correction for time difference was performed. If "NO", the processing comes to END. However, if "YES", the flow proceeds to a step (S-99), in which the time setting flag is set "ON" (ZESA_SYU=1). Subsequently, the flow proceeds to a step (S-100), in which the range for correction for time difference is set.

And, when the correction mode for time difference, is calculated, an operation for substituting it into the time difference value is performed, thereby the processing comes to END.

In the above-described first concrete example of the present invention, since the above-described construction is adopted, a radio controlled timepiece is obtained in which, in a case when the user who uses A radio controlled timepiece moves from one country or region to another where the time difference is different from each other, the time difference adjusting operation for adjusting the time difference is needed, can be performed with only one radio wave receiving operation without performing complicated two separate operations such as an operation of correcting time difference between those countries or regions and an operation of correcting time difference based on daylight saving time and the timepiece of the present invention is very convenient to use.

Next, a second concrete example of a radio controlled timepiece according to the present invention will be explained in detail.

Namely, the second concrete example of the present invention is a radio controlled timepiece that is constructed in the way that, in a radio controlled timepiece used in the above-described concrete example, in addition, when the user of a radio controlled timepiece performs time difference correction operation, to performing ordinary correction for time difference, according to the time difference that is predetermined, between a plurality of countries or a plurality of regions, when the user advances or delays the displayed time of a radio controlled timepiece, by a suitable amount of time, on account of his or her own convenience, from that standard displayed time, for example, in units of an hour, a minute, or a second, those relevant operations can be performed simply and easily by eliminating the drawbacks that are inherent in the prior techniques.

Namely, a radio controlled timepiece according to the second concrete example of the present invention, as in the case of, for example, a radio controlled timepiece as shown in the first concrete example, a radio controlled timepiece comprises a reference signal generating means that outputs a reference signal, a time keeping means that outputs time keeping information based upon the reference signal, a display means that displays time information based upon the time keeping information, and a receiving means that receives a standard radio wave having reference time information including the universal standard time information, whereby output time information output from the time keeping means can be corrected based upon the reception signal output from the reception means, and further wherein the radio controlled timepiece comprising an offset time difference information storage means that stores an offset time difference formed between a region where the reference time information is formed and a region where the standard radio wave has been received, a daylight saving time information storage means that stores therein information whether or not a daylight saving time is being executed in the region where the standard radio wave has been received and a local standard time information forming means that executes an operational processing for the reference time information of the standard radio wave that has been received in a particular region with utilizing at least one of the offset time difference information with respect to the reference time information corresponding to the particular region and the daylight saving time information used in the particular region, so as to form the local standard time information in the particular region, and the timepiece further separately comprising an input means that inputs time difference information that is taken with respect to the time information.

In a radio controlled timepiece according to the above-described second concrete example of the present invention, the user can input, by using the input means, an arbitrary item of time difference information in an arbitrary point of time and at an arbitrary place into an appropriate storage means of A radio controlled timepiece, and can store it. Therefore, the user can easily and reliably perform correction of time that corresponds to the time difference in a relevant country or region.

Also, in this concrete example, the input means preferably is equipped with a first input operation system that enables inputting the time difference information in units of an hour.

As a result, since inputting the time difference information can be performed in units of an hour, the setting operation for setting the time difference can be quickly performed.

Also, in this concrete example, it is also preferable that the input means can be equipped with either one, or both, of a second input operation system that corrects with units of an hour, the counted time information that is counted by the time keeping means and a third input operation system that corrects the counted time information with units of a minute.

As a result, in a case when the time correction is manually performed, regarding the setting operation for setting the time difference, if when a correction for displayed time is performed, regarding a correction for hours it can be performed with an unit of an hour, while regarding a correction for minutes it can be performed with an unit of a minute or with an unit of a second.

Therefore, time correction can be performed easily and reliably.

Further, in this concrete example, it is also preferable that the timepiece can be equipped with a time difference clearing means that makes the time difference information that the storage means stores invalid by the operation of the input means.

As a result, since it is possible to make the time difference information that has been input, invalid, without having the time information of the standard radio wave that will be received at the next time, corrected by the time difference information, the time information that has been received can be displayed as it is.

A method of controlling a radio controlled timepiece according to the present invention, as will be understood from the explanation that has been made as above, is, for example, a radio controlled timepiece that comprising a reference signal generating means that outputs a reference signal, a time keeping means that outputs time keeping information based upon said reference signal, a display means that displays time information based upon said time keeping information, and a receiving means that receives a standard radio wave having reference time information, whereby output time information output from said time keeping means can be corrected based upon said reception signal output from said reception means, wherein said method comprising the steps of;

storing an offset time difference formed between a region where the reference time information is formed and a region where the standard radio wave has been received in an offset time difference information storage means;

storing information whether or not a daylight saving time is being executed in the region where the standard radio wave has been received in a daylight saving time information storage means; and forming local standard time information in the particular region by executing an operational processing for reference time information of a standard radio wave that has been received in a particular region with utilizing at least one of said offset time difference information with respect to said reference time information corresponding to a particular region and said daylight saving time information used in said particular region, in a local standard time information forming means.

Incidentally, in the above-described method of controlling A radio controlled timepiece, it is preferable that the reference time information be universal standard time information.

Further, in the above-described method of controlling a radio controlled timepiece, it is also preferable, as a concrete example, that it be constructed in the way that the step of forming the local standard time information executes calculation processing with respect to the local standard time information by using daylight saving time information in that particular region.

Also, in the above-described method of controlling a radio controlled timepiece of the present invention, it is also preferable that, when executing, in the reception means, the step of performing a control for enabling automatically selectively receiving either one of a first standard radio wave including a first reference time information and a second standard radio wave including a second reference time information, the method comprises a step of, in a case when it has been recognized that the first standard radio wave has been received the first time difference data is set in the offset time difference information storage means and a step of, in a case when it has been recognized that the second standard radio wave has been received, the second time difference data is set in the offset time difference information storage means.

On the other hand, in the above-described method of controlling A radio controlled timepiece of the present invention, it is also preferable to construct the method in the way that the method comprises a step of storing into a received radio wave belonging country name storage means, the country information that has been recognized from the standard radio wave that has been received in the reception means according to the automatic selective-reception control operation and a step of, in a case when the standard radio wave that is received has been altered, setting again at least one of offset time difference information in offset time difference information storage means in the particular region and daylight saving time information in daylight saving time information storage means in the particular region.

Also, in the above-described method of controlling a radio controlled timepiece of the present invention, it is also preferable to construct it in the way that it further comprises a step of inputting time difference information with respect to time information through the appropriate input means that is provided in A radio controlled timepiece; and, in that input operation, that time difference information is input with units of an hour.

Figure 8:
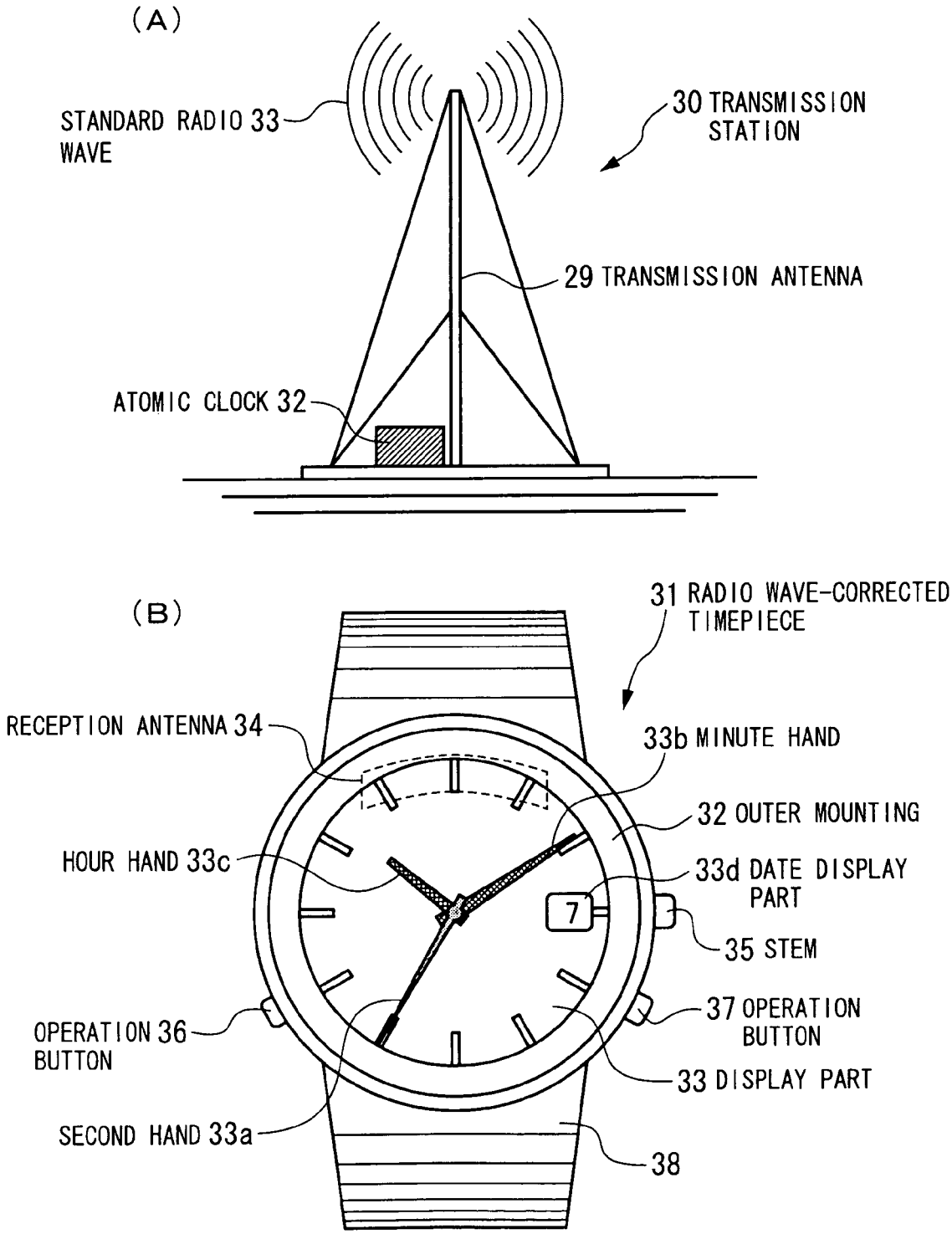
FIGS. 8(A) and 8(B) are explanatory views illustrating the relationship between A radio controlled timepiece according to an embodiment of the present invention and a transmission station that transmits a standard radio wave.

Hereinafter, an embodiment of a radio controlled timepiece according to the second concrete example of the present invention will be explained in detail with reference to the drawings. FIG. 8 is an explanatory view illustrating the relationship between A radio controlled timepiece according to the embodiment of the present invention and a transmission station that transmits a standard radio wave. In FIGS. 8(A) and 8(B), a reference numeral 31 denotes an analog display type radio controlled timepiece.

A reference numeral 32 denotes an outer piece of mounting that is made of metal, etc; and a reference numeral 33 denotes a display part that serves as the display means and is constructed of a second hand 33*a*, a minute hand 33*b*, an hour hand 33*c*, and a date display part 33*d* that displays the current date information.

A reference numeral 34 denotes a reception antenna of ultra-miniaturized type. Although it is disposed at the position that is located around in the direction to 12 o'clock inside the outer mounting 32, its position is not limited thereto.

For example, it may be located around in the direction to 9 o'clock. Also, that position may be anywhere if it is located within the timepiece. A reference numeral 35 denotes a stem that corrects time and date and that corresponds to a part of the input means, and, although described later, is interlocked with a plurality of electric switches. Reference numerals 36 and 37 denote an operation button that corresponds to part of the input means and, although described later, they are interlocked with electric switches. A reference numeral 38 denotes a band for allowing the user (not illustrated) to wear on his or her wrist.

A reference numeral 30 denotes a transmission station that transmits a standard radio wave that includes time information that is a standard time. A reference numeral 29 denotes a transmission antenna that radiates a standard radio wave, and a reference numeral 32 denotes an atomic clock that performs counting of a standard time with a high accuracy. A reference numeral 33 denotes a standard radio wave that carries the standard time serving as time information that is transmitted from the transmission antenna 31. The standard radio wave 33 is ordinarily composed of a long wave whose frequency is several tens of KHz and can be received within a range the radius of that is around 1000 Km or so. Incidentally, the transmission frequency and time information format of the standard radio wave 33 are individually set in the transmission stations in each country or region.

Here, for receiving the standard radio wave 33 by A radio controlled timepiece 31, preferably, the position where the reception antenna 34 of A radio controlled timepiece 31 is located is directed toward the location of the transmission station 30, then the reception starting button (for example, the operation button 37) is pressed down. As a result, a radio controlled timepiece 31 starts to perform the reception operation to receive the standard radio wave 33. Next, a radio controlled timepiece 31 performs to decode the standard radio wave by using a decoding algorism that corresponds to the time information format of the standard radio wave 33. Thereby, it acquires time information such as second, minute, and hour and date and, according to the necessity, presence/absence data such as a leap year and daylight saving time. Then, it performs time counting on the time information that it has acquired to thereby display the time information and date through the use of the display part 33. Incidentally, receiving the standard radio wave, preferably, is periodically executed at the time such as the middle of night when the noises are less and the reception environment is good.

Figure 9:
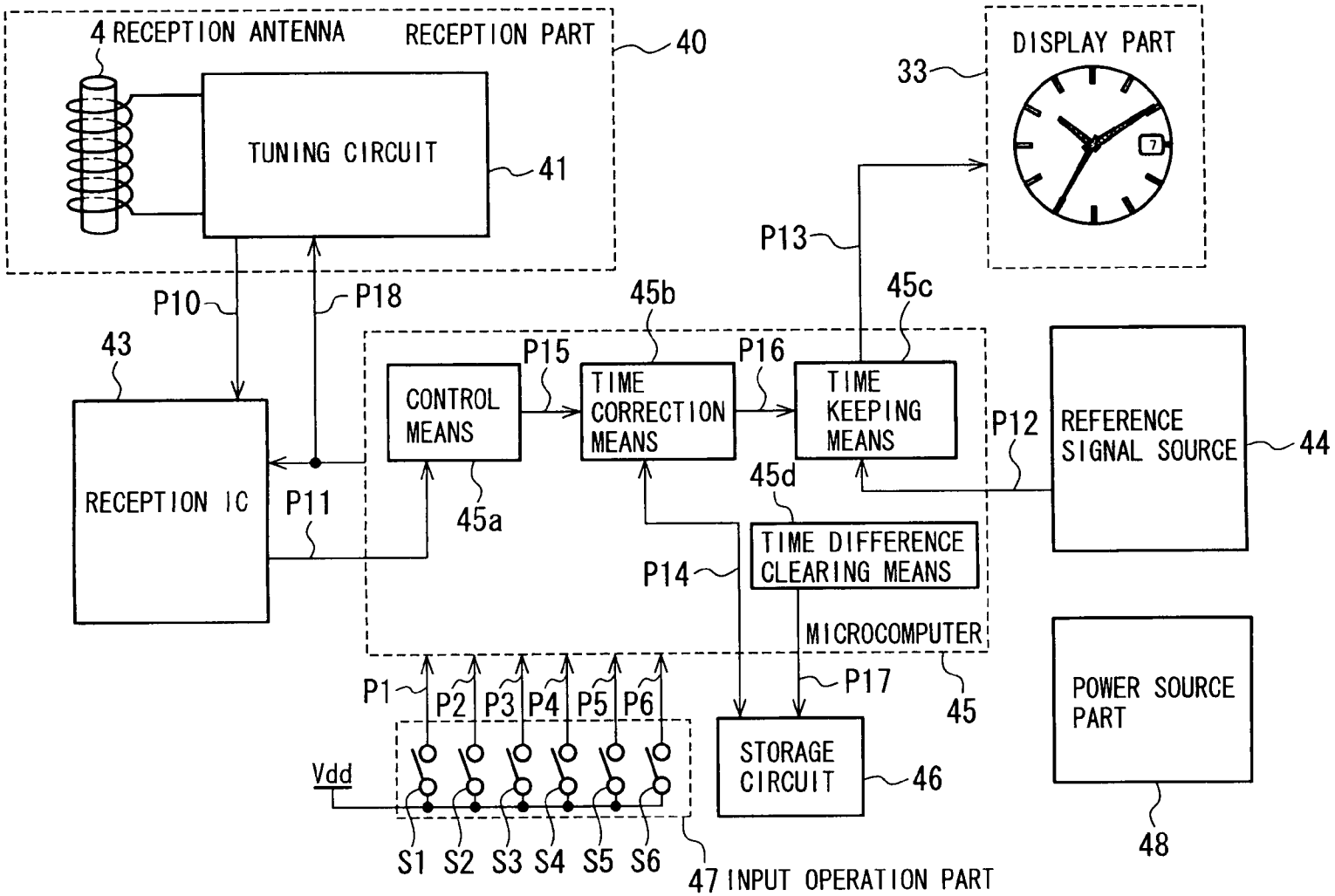
FIG. 9 is a block circuit diagram of A radio controlled timepiece according to the present invention.

Next, the construction of a circuit block diagram of A radio controlled timepiece 31 according to the embodiment of the present invention and the operation of it will be explained with reference to FIG. 9. In FIG. 9, a reference numeral 40 denotes a reception part that serves as the reception means and that is constructed of the reception antenna 34 that receives the standard radio wave and a tuning circuit 41 for selectively receiving the standard radio wave in tune with the reception antenna 34 to output a tune signal P10. A reference numeral 43 denotes a reception IC, which inputs the tune signal P10 to output demodulated signal P11 that has been digitized. A reference numeral 44 denotes a reference signal source having therein a crystal oscillator (not illustrated) to output a reference signal P12 for performing time counting.

A reference numeral 45 denotes a micro-computer that, although the detail is described later, inputs the demodulated signal P11 and the reference signal P12 to output time keeping data P13 that serves as the time keeping information.

A reference numeral 46 denotes a storage circuit serving as storage means, which stores time difference data P14 serving as time difference information from the microcomputer 45. A reference numeral 47 denotes an input operation part that corresponds to part of the input means and that is constructed of switches S1 to S6 that output switch signals P1 to P6. These switch signals P1 to P6 are input to the microcomputer 45. Incidentally, terminals on one side of the switches S1 to S6 are connected to a power source Vdd.

Here, the switch S1 is turned ON by the operation button S36 as shown in FIG. 8, being depressed. The switch S2 is turned ON by the operation button 37 being depressed. Also, the switch S3 is turned ON by the stem 35 that is illustrated in FIG. 8 being pulled by one step; the switch S4 is turned ON by the stem 35 being pulled by two steps. Also, the switch S5 is turned ON by rotating the stem 35 in the direction to 12 o'clock of A radio controlled timepiece 31; and the switch S6 is turned ON by rotating the stem 35 in the direction to 6 o'clock.

Next, the main internal function of the microcomputer 45 will be explained.

A reference symbol 45*a* denotes a control means that decodes the standard radio wave that has been received, which control means inputs a demodulated signal P11 from a reception IC 43 to output time data P15 serving as time information.

A reference symbol 45*b* denotes time correction means that inputs the time data P15 and the time difference data P14 from the storage circuit 46 and outputs time setting data P16 serving as time information. A reference symbol 45*c* denotes time keeping means that inputs the time setting data P16 and reference signal P12 and outputs the time keeping data P13 serving as the time keeping information.

A reference symbol 45*d* denotes time difference clear means that outputs a time difference clear signal P17 to the storage circuit 46. Also, the microcomputer 45 outputs a reception start signal P18 that instructs the start of reception of the standard radio wave, to a tuning circuit IC 21 and the reception circuit 43.

Also, although not illustrated, the microcomputer 45 has a control function, by inputting the switch signals P1 to P6 from the input operation part 47, to change over the same to the operation modes, respectively. As described above, the microcomputer 45 is an element that plays the role of the core of A radio controlled timepiece 31 to control the over-all operation flow of A radio controlled timepiece 31.

Also, the above-described operation buttons 36 and 37 and stem 35, the input operation part 47, and the microcomputer 45 correspond to the first, the second, and the third input operation system, respectively, that are defined in the present invention.

Next, the display part 33 is constructed, as described above, of the second hand 33*a*, minute hand 33*b*, hour hand 33*c*, and date display part 33*d*. Although not illustrated, it has a mechanical transmission that is composed of a motor, a gear train, etc. It thereby inputs the time keeping data P13 to display a time. Incidentally, the motor that is built into the display part 33 is constructed of a first motor for driving the second hand 33*a* and minute hand 33*b* and a second motor for driving the hour hand 33*c* and date display part 33*d*. A reference numeral 48 denotes a power source, which comprises a primary battery, or a secondary battery that is electrically charged by a solar battery (not illustrated), or the like. Although not illustrated, it supplies a power source to the respective circuit blocks through a power source line.

Next, the basic operation of a radio controlled timepiece 31 according to the embodiment of the present invention will be explained using FIG. 9. When the power source 48 supplies the power to the respective circuit blocks through the power source line (not illustrated), the microcomputer 45 executes initialization processing to initialize the respective circuit blocks.

As a result, the time keeping means 45*c* of the microcomputer 45 is initialized to 00:00:00 a.m. On the other hand, the display part 33 is driven by the time keeping data P13 from the time keeping means 45*c*, then the second hand 33*a*, minute hand 33*b*, and hour hand 33*c* of the display part 33 are moved to their reference position of 00:00:0 a.m., while the date display part 33*d* is also moved to its reference position.

Next, the reference signal source 44 starts outputting the reference signal P12; and the microcomputer 45 inputs that reference signal P12 and starts counting time with units of a second by its time keeping means 45*c* to update the time keeping data P13. The display part 33 starts to move the second hand at every second according to the time keeping data P13 from the microcomputer 45.

Next, the microcomputer 45, by the reception start operation from the outside (for example the depression of the operation button 37), or by receiving the reception starting instruction that is issued from an internal timer, outputs the reception start signal P18. The tuning circuit 41 of the reception part 40 inputs the reception start signal P18, thereby forming a tuning circuit along with the reception antenna 34, and receives the standard radio wave that has been selected so as to output a tuned signal P10.

Next, the reception IC 43 starts amplification and detection of the tuned signal P10 upon receipt of the reception start signal P18 to thereby output the demodulated signal P11 that has been digitized. The control means 45*a* of the microcomputer 45 inputs the demodulated signal P11 and, according to the decoding algorism that is stored therein, decodes the time information format of that demodulated signal P11 to acquire time information such as second, minute, hour, day, etc. that serves as time information.

The time correction means 45*b* of the microcomputer 45 inputs the time data P15 serving as time information that has been acquired in the control means 45*a* and performs to add the time data P15 and the time difference data P14 stored in the storage circuit 46 and outputs that added result as the time setting data P16. Namely, the time setting data P16 is time information that has been obtained by correcting the time data P15 with the time difference data P14.

Next, the time keeping means 45*c* stores the input time setting data P16 as time keeping information and sequentially performs the time keeping operation for counting the time keeping information that has been stored, at every second, using the reference signal P12 and outputs that result as the time keeping data P13. As a result, the display part 33 displays the converted time that has been obtained by correcting the time data P15 that was received with adding thereto the time difference data P14, and it continues to perform the 1-second hand movement on the second hand.

Also, the time difference clearing means 45*d*, although the detail will be described later, outputs the time difference clearing signal P17 by the operation of the input operation part 47. The storage circuit 46, upon receipt of the time difference clearing signal P17, clears the time difference data P14 that is stored therein, resulting that the time difference data P14 is stored is cancelled and the time difference data P14 becomes zero. Here, when the time difference data P14 has been cleared to become a time difference of zero, the time setting data P16 becomes equal to the time data P15, as the result that the display part 33 displays the time that corresponds to the time data P15 that was obtained by reception, as it is. Incidentally, the time difference data P14 that is stored in the storage circuit 46 is input by operating the input operation part 47 and stored, the detail of that in terms of the method of inputting will however be described later in detail.

Figure 10:
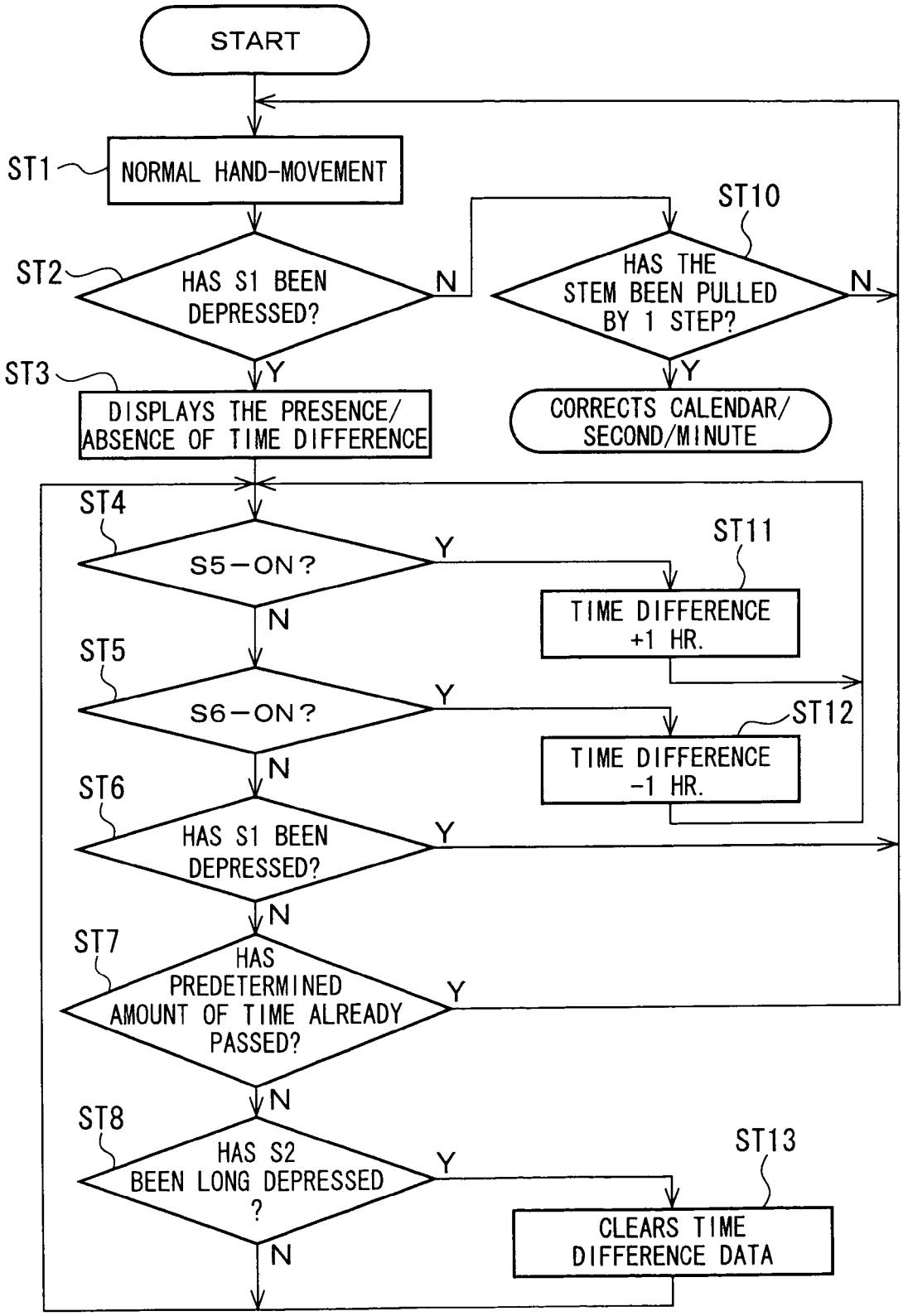
FIG. 10 is a flow chart illustrating a time difference setting method for A radio controlled timepiece according to a first embodiment of the present invention.
Figure 11:
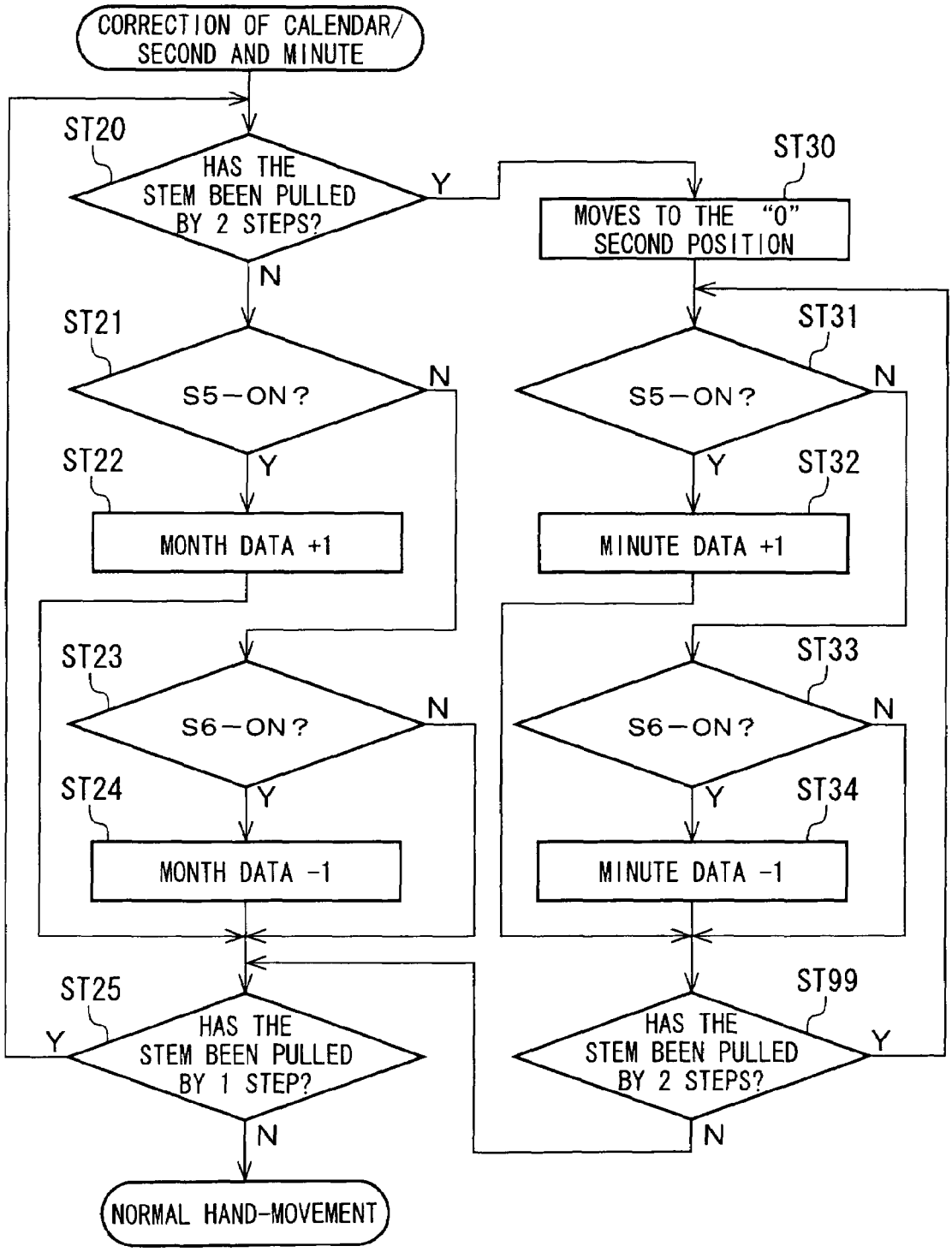
FIG. 11 is a flow chart illustrating a calendar/sec. and min. correcting method for A radio controlled timepiece according to the first embodiment of the present invention.
Figure 15:
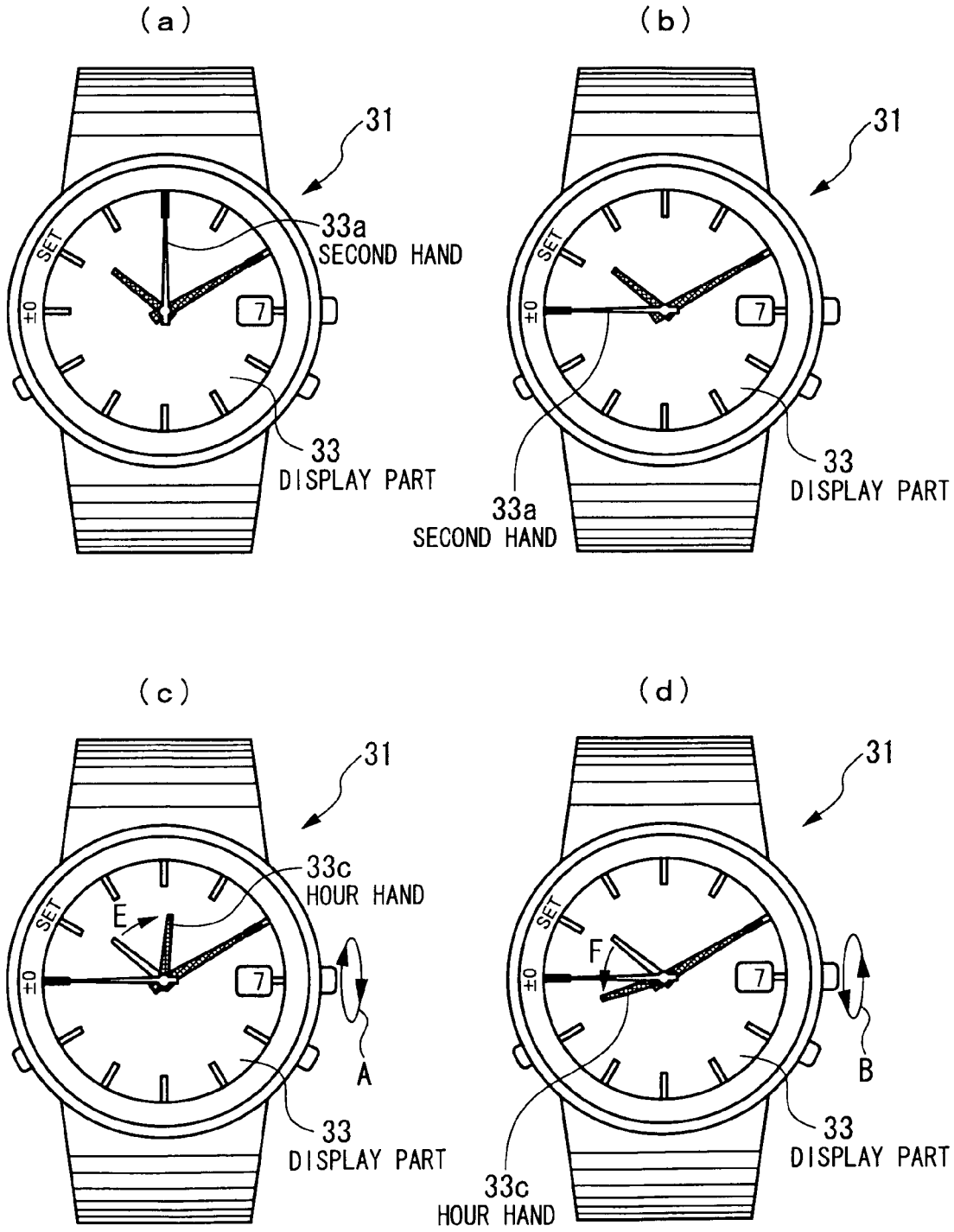
FIGS. 15(*a*), 15(*b*), 15(*c*), and 15(*d*) are explanatory views illustrating a state of display that comes up in a time difference setting mode for A radio controlled timepiece according to the first embodiment of the present invention.

Next, a method of performing time difference setting and correction of calendar/second and minute of A radio controlled timepiece 31 according to a first embodiment of the present invention will be explained with reference to FIGS. 10, 11, and 15. FIG. 10 is a flow chart illustrating the method of performing time difference setting and FIG. 11 is a flow chart illustrating the method of performing correction of calendar/second and minute. Also, FIGS. 15(*a*), 15(*b*), 15(*c*), and 15(*d*) illustrate states of display of the display part 33 of A radio controlled timepiece 31 in the time difference setting mode in the embodiment in the second concrete example of the present invention. The embodiment in the second concrete example will be explained in the way of including this FIG. 15.

In FIG. 10, a radio controlled timepiece 31 is performing a normal second hand-movement by every one second (Flow-ST1). FIG. 15(*a*) illustrates a displayed state of the display part 33 during the normal hand-movement operation, and, as an example, is displaying 10 (hour):10 (minute):00 (second) a.m. the date being displayed as a 7th day.

Also, at the position corresponding to "50 seconds" on the peripheral portion of the display part 33 there is marked the word "SET" indicating that the time difference is being set.

Also, at the position corresponding to "45 seconds" there is marked the symbol "±0" indicating that the time difference is not set. This is for the purpose of indicating the stored state of the time difference data P14 by way of a second hand 33*a*, the detail of that will be described later.

Incidentally, although, in this embodiment, the marks "SET" and "±0" have been assigned, respectively, at the positions of "50 seconds" and "45 seconds", they maybe assigned at other positions and, in addition, the symbols or word letters may also be arbitrarily determined.

Incidentally, in the normal hand-movement in the flow ST1, it is premised that the stem 35 is located at the position of zero position (namely, the switches S3 and S4 are both turned "OFF").

Also, regarding the normal hand-movement, here, there can be assumed two cases, in one of that the hand movement is performed by receiving the standard radio wave, with correctly synchronization with the standard time so as to make the hand movement exactly in coincidence with this relevant time, and in the other of that the hand movement is carried out under the state where the standard radio wave is unable to be received for some reason or other, or the standard radio wave is not being received.

Next, the microcomputer 45 inputs the switch signal P1 and knows the state of the switch S1 and determines whether or not the switch S1 is depressed. When "YES" is made (namely the operation button 36 is depressed), the flow proceeds to a flow ST3 and, when "NO" is made, the flow proceeds to a flow ST10 (flow ST2). Here, the switch S1 functions as a switch for making a transfer to the time difference setting mode, and, the processing that is executed from a flow ST3 and those being followed thereafter becomes the one that is in the time difference setting mode.

Hereinafter, the operational flows from the flow ST3 downward, i.e. the ones in the time difference setting mode will be explained. When a radio controlled timepiece 31 is transferred to the time difference setting mode, in a case when the time difference data P14 is already stored and set in the storage circuit 46, the second hand 33*a* is moved to the above-described position "SET" of the display part 33 while, on the other hand, in a case when the time difference data P14 is not set (namely when the time difference data P14=zero time), the second hand 33*a* is moved to the position "±0" of the display part 33 (flow ST3) corresponding to the position of the 45 second. FIG. 15(*b*) illustrates an example of the displayed state of the display part 33 in the stage of flow ST3. Here, since no time difference is set, the second hand 33*a* is moved to the position "±0", i.e. the position corresponding to "45 seconds". Accordingly, in the flow ST3, the user can confirm the presence or absence of the setting for time difference by the motion of the second hand 33*a*.

Next, the time difference inputting flow, executed by rotating the stem 35, in the time difference setting mode will be explained. The microcomputer 45, by inputting a switch signal P5, detects the state of the switch S5 that is turned ON interlockingly with the rotation of the stem 35 in the direction to 12 o'clock, and determines whether or not the switch S5 has been turned ON. When "YES" is made (namely the stem 35 has been rotated in the direction to 12 o'clock), the operational flow proceeds to a flow ST11, whereas, when "NO" is made, it proceeds to the next flow ST5 (flow ST4).

When "YES" is made in the flow ST4, the microcomputer 45 adds 1 hour to the time difference data P14 and causes this new time difference P14 to be stored in the storage circuit 46. At the same time, it also adds 1 hour to the time keeping data P13 that is the time keeping information of the time keeping means 45*c* (flow ST11). Here, as a result of the fact that the time keeping means 45*c* has been added by 1 hour thereto, the time keeping data P13 becomes 11 (hour):10 (minutes) a.m. from 10 (hour):10 (minutes) a.m.

As a result, the hour hand 33*c* of the display part 33 is moved to the position where it is advanced by 1 hour. Incidentally, after finishing the flow ST11, the operation is returned to the flow ST4, in which determination on the switch S5 is repeatedly executed.

As a result, if the user continuously rotates the stem 35 in the direction to 12 o'clock, the flow ST11 is continuously executed, thereby the time difference data P14 has continuously been added by 1 hour thereto and the resulted data is stored in the storage circuit 46. The hour hand 33*c* also is repeatedly advancing to move with units of an hour. FIG. 15(*c*) illustrates a state where the displayed time has become 12 (hour):10 (minute) p.m. by rotating the stem 35 in the direction indicated by the rotation arrow A (namely toward 12 o'clock) and by a time difference corresponding to 2 hours being thereby added and the hour hand 33*c* being thereby advanced to a position as indicated by the arrow E by the extent of 2 hours so that the display means displays a time of 12:10 PM.

Next, when "NO" is made in the flow ST4, the microcomputer 45 inputs a switch signal P6 and detects the state of the switch S6 whether or not that becomes ON interlockingly with the rotation in the direction to 6 o'clock of the stem 35. It thereby determines whether or not the switch S6 has been made (turned) ON.

When "YES" is made (namely the stem 35 has been rotated in the direction to 6 o'clock), the operational flow proceeds to a flow ST12, whereas, when "NO" is made, it proceeds to a flow ST6 (flow ST5).

When "YES" is made in the flow ST5, the microcomputer 45 subtracts 1 hour from the time difference data P14 and stores this new time difference data P14 into the storage circuit 46.

Simultaneously, it also subtracts 1 hour from the time keeping data P13 that is the time keeping information of the time keeping means 45*c* within it (flow ST12). Here, as a result of the fact that the time keeping means 45*c* being subtracted by 1 hour, the time keeping data P13 becomes 9:10 a.m. from 10:10 a.m., thereby the hour hand 33*c* of the display part 33 is moved to the position where it is delayed by the extent of 1 hour. Incidentally, after the flow ST12 is finished, the operation is returned to the flow ST4, whereby determination on the switches S5 and S6 is repeatedly executed.

As a result, if the user continuously rotates the stem 35 in the direction to 6 o'clock, the flow ST12 is continuously executed, thereby the time difference data P14 has continuously been subtracted by 1 hour therefrom and is stored in the storage circuit 46. The hour hand 33*c* also is repeatedly delayed by units of an hour. FIG. 15(*d*) illustrates a state where the displayed time has become 8:10 a.m. by rotating the stem 35 in the direction along the rotation arrow B (namely toward 6 o'clock) and by a time difference's corresponding to 2 hours was thereby subtracted and the hour hand 33*c* being thereby delayed by 2 hours as indicated by the arrow F.

Next, when "NO" is made in the flow ST5, the microcomputer 45 inputs a switch signal P1 and detects the state of the switch S1. It thereby determines whether or not the switch S1 has been depressed. When "YES" is made (namely the operation button 36 has been depressed), the operational flow is returned to the normal hand-movement in the flow ST1, whereas, when "NO" is made, it proceeds to the next flow ST7 (flow ST6). Namely, when the switch S1 is depressed again in the time difference setting mode showing in the flow s as defined by the flows after the flow ST3 inclusive, it results that the operation is returned to the normal hand-movement.

Next, when "NO" is made in the flow ST6, the microcomputer 45 examines the value of a timer (not illustrated) within it and determines whether or not a predetermined elapsed time has passed. When "YES" is made (namely the time is zero second), the operation is returned to the normal hand-movement in the flow ST1, whereas, when "NO" is made, the operation proceeds to the next flow ST7.

Here, since the timer within the microcomputer 45 counts down when all the switches S1 to S6 are in the "OFF" state, the flow ST7 operates as an auto-return function so that it automatically returns to the normal hand-movement when the user in the time difference setting mode continues his or her non-operation status for a fixed amount of time.

Next, when "NO" is made in the flow ST7, the microcomputer 45 inputs the switch signal P2 and knows the state of the switch S2 and determines whether or not the switch S2 had been depressed for a long time. When "YES" is made (namely the operation button 37 had been depressed for a long time), the operation proceeds to a flow ST13, whereas, when "NO" is made, the operation is returned to the flow ST4 (flow ST8).

Next, when "YES" is made in the flow ST8, in the flow 13, the microcomputer 45 starts the time difference clearing means 45*d* to output time difference clear signal P17 and then clears the time difference data P14 stored in the storage circuit 46 to make it zero time. Thereafter, the control operation is returned to the flow ST4 (flow ST13).

As a result, in a case when a standard radio wave having received is the next time, the time correction means 45*b* of the microcomputer 45 adds the time data P15 that is the time information that has been received and the time difference data P14 together to output the time setting data P16. However, since the time difference data P14 is cleared, the time setting data P16 resultantly becomes equal to the time data P15, whereby the time that is displayed on the display part 33 becomes the time data P15, namely the standard time that has been received.

Also, in a case when "NO" is made in the flow ST8 and, without the flow ST13 being executed, the control operation is returned to the normal hand-movement by depressing of the switch S1 or operation of the timer, the time difference data P14 in the storing means 46 is freed from being cleared and is valid.

And, in a case when having received a standard radio wave thereafter, the time setting data P16 that is input to the time keeping means 45*c* of the microcomputer 45, as stated before, becomes a value that is obtained by the time data P15 and time difference data's P14 of the storage circuit 46 being added or subtracted. As a result, the time that is displayed in the display part 33 becomes time that has been obtained by the time difference data's P14 being processed with respect to the standard time that has been received (namely the time data P15).

Next, an explanation will be given of a case where "NO" determination is made in the flow ST2. Namely, when "NO" determination is made in the flow ST2, the microcomputer 45 in the flow ST10 inputs a switch signal P3 and detects the state of the switch S3 and determines whether the switch S3 has been turned ON (namely the stem has been pulled by one step). When in the flow ST10 "YES" determination is made, the control operation is transferred to the calendar/second and minute correction mode, whereas, when "NO" determination is made, the control operation is returned to the flow ST1, whereby the normal hand-movement continues to be performed (flow ST10).

Next, an explanation will be given of a method of manually performing correction of calendar/second and minute. When "YES" determination is made in the flow ST10, a transfer is made to the calendar/second and minute correction mode that follows a flow ST20 and its thereafter-succeeding flows that are illustrated in FIG. 11. Here, in the flow ST20, the microcomputer 45 inputs a switch signal P4 and detects the state of the switch S4 and determines whether the switch S4 has been turned ON (namely the stem 35 has been pulled by two steps). When "YES" determination is made, the flow proceeds to a flow ST30 in which the second and minute correction mode is executed, whereas, when "NO" determination is made, the flow proceeds to a flow ST21 in which the calendar correction mode is executed (flow ST20).

Next, an explanation will be given of the calendar correction mode that is executed when "NO" determination is made in the flow ST20. The microcomputer 45 inputs a switch signal P5 and detects or knows the state of the switch S5 and determines whether the switch S5 has been turned ON. When "YES" determination is made (namely the stem 35 has been rotated in the direction to 12 o'clock), the flow proceeds to a flow ST22, whereas, when "NO" determination is made, the flow proceeds to a flow ST23 (flow ST21).

When "YES" determination is made in the flow ST21, the microcomputer 45 adds +1 to month data of the time keeping means 45*c* and updates the time keeping data P13 that is the output of the time keeping means 45*c*. Then, it moves the second hand 33*a* to a "month" display position that is predetermined, though not illustrated (flow ST22). Although the detail is omitted, it may be arranged that not only correction of "month" but also correction of year that has lapsed from a relevant leap year be performed along with correction of "month". Incidentally, after finishing the execution of the flow ST22, the flow proceeds to a flow ST25 that will be described later.

Next, when "NO" determination is made in the flow ST21, the microcomputer 45 inputs a switch signal P6 and knows the state of the switch S6 and determines whether the switch S6 is turned ON. When "YES" determination is made (namely the stem 35 has been rotated in the direction to 6 o'clock), the flow proceeds to a flow ST24, whereas, when "NO" determination is made, the flow proceeds to a flow ST25 (flow ST23).

When "YES" determination is made in the flow ST23, the microcomputer 45 subtracts −1 from the month data in the time keeping means 45*c* and updates the time keeping data P13 that is the output of the time keeping means 45*c*. Then, although not illustrated, it moves the second hand 33*a* to the "month" display position that is predetermined (flow ST24). Although the detail is omitted, it may be arranged that not only correction of "month" but also correction of year that has lapsed from a relevant leap year be performed along with correction of "month". Incidentally, after finishing the execution of the flow ST24, the flow proceeds to a flow ST25.

Next, after executing the flow ST22 and flow ST24, or in case "NO" determination is made in the flow ST23, the microcomputer 45 inputs the switch signal P3 and knows or detects the state of the switch S3 and determines whether the switch S3 is in ON state (namely the stem 35 is pulled by one step). When "YES" determination is made, the flow is returned to the flow ST20, whereas, when "NO" determination is made, the microcomputer finishes the execution of the calendar/second and minute correction. Thereby, the control is returned to the normal hand-movement (flow ST25).

Next, an explanation will be given of the second and minute correction mode that is executed when "YES" determination has been made in the flow ST20. The microcomputer 45 resets the second data of the time keeping data P13 to zero second and then moves the second hand 33*a* to the zero-second position (flow ST30).

Next, the microcomputer 45 in a flow ST31 inputs the switch signal P5 and detects the state of the switch S5 and determines whether the switch S5 has been turned ON. When "YES" determination (namely the stem 35 has been rotated in the direction to 12 o'clock), the control operation proceeds to a flow ST32, whereas, when "NO" determination is made, the control proceeds to a flow ST33 (flow ST31).

When "YES" determination is made in the flow ST31, the microcomputer 45 adds +1 to the minute data of the time keeping means 45*c* and, according to the time keeping data P13 that is the output of the time keeping means 45*c*, although not illustrated, advances the minute hand 33*b* by the extent of one minute (flow ST32). Incidentally, after termination of the flow ST32, the control proceeds to a flow ST99.

Next, when "NO" determination is made in the flow ST31, the microcomputer 45 inputs the switch signal P6 and detects the state of the switch S6 and determines whether the switch S6 has been turned ON. When "YES" determination is made (namely the stem 35 has been rotated in the direction to 6 o'clock), the control proceeds to a flow ST34, whereas, when "NO" determination is made, the control proceeds to the flow ST99 (flow ST33).

When "YES" determination is made in the flow ST33, the microcomputer 45 subtracts −1 from the minute data of the time keeping means 45*c* and delays the minute second 33*b* although not illustrated according to the time keeping data P13 that is the output of the time keeping means 45*c* (flow ST34). Incidentally, after termination of the flow ST34, the control flow proceeds to the flow ST99.

Next, in the flow ST99, the microcomputer 45 inputs the switch signal P4 and detects the state of the switch S4 and determines whether the switch S4 has been turned ON (namely the stem 35 has been pulled by two steps). When "YES" determination is made, the flow proceeds to the flow ST31, whereas, when "NO" determination is made, the flow proceeds to the flow ST25 (flow ST99). As a result, if, at the point of time when correcting the minute hand 33*b* has finished being performed, returning the stem 35 to the "zero" step position according to the "zero" second at the standard time over the telephone, etc., "NO" determination is made in both the flow ST99 and the flow ST25 and the flow is returned to the ordinary run of hand. Therefore, the second hand 33*a* can also be subjected to accurate correction of the time.

As described above, according to the second embodiment of the present invention, by depressing the operation button 36, A radio controlled timepiece 31 is transited to the time difference setting mode. And, by rotating the stem 35 in the direction to 12 o'clock or 6 o'clock at the "zero" step position of that stem 35, the time difference data P14 with respect to the time information that has been received can be input in units of an hour. The input operation system in this time difference setting mode corresponds to the first input operation system that is defined in the present invention.

In addition, by bringing the stem 35 to the state where it has been pulled by one step, A radio controlled timepiece 31 is transferred to the calendar correction mode. And, by rotating the stem 35 in the direction to 12 o'clock or 6 o'clock, it is possible to manually perform calendar correction (namely the month correction and passed year-of-leap-year correction) Also, by bringing the stem 35 to the state where it has been pulled by two steps, A radio controlled timepiece 31 is transferred to the second and minute correction mode. And, by rotating the stem 35 in the direction to 12 o'clock or 6 o'clock, the time keeping data P13 can be corrected in units of a minute or in units of a second. The input operation system in this second and minute correction mode is the third input operation system that is defined in the present invention.

Also, the time keeping data P13 can also be corrected in units of an hour. The input operation system in this hour correction mode is the second input operation system that is defined in the present invention.

Next, an explanation will be given to what way the time difference data P14 that has been input and stored in the time difference setting mode is used in the state of actual use of a radio controlled timepiece 31. As a first example of the state of such use, it is assumed that the user of A radio controlled timepiece 31 stay in Germany in Europe and is receiving the DCF 77 that is the German standard radio wave transmission station.

At this time, a radio controlled timepiece 31 is displaying correctly a German standard time through the standard radio wave of the DCF77. Here, it is assumed that the user of a radio controlled timepiece 31 have moved from Germany to Great Britain.

In England, although it is possible to receive the standard radio wave of the DCF77, the standard time in England is delayed by 1 hour from that in Germany. Therefore, time correction becomes necessary.

Thereupon, the user of a radio controlled timepiece 31, upon arrival at England, operates the operation button 36 so as to depress the switch S1, thereby to change the current mode of normal hand-movement operation to the time setting mode that is started from the flow ST3, as was explained in connection with the flow chart of FIG. 10. And, the user rotates the stem 35 in the direction to 6 o'clock and thereby turns the switch S6 ON to cause executing the flow ST12 to subtract 1 hour from the time difference data P14. Resultantly, into the storage circuit 46, there is stored a value of −1 hour as the time difference data P14 while, on the other hand, the time keeping information that is stored in the time keeping means 45*c* of the microcomputer 45, is also subtracted by 1 hour. Therefore, the hour hand 33*c* displays a time that has been delayed by 1 hour, i.e. the time that is equal to the standard time in England.

Next, in England, a radio controlled timepiece 31 receives the radio wave that is transmitted from the German transmission station DCF77. Here, since the standard time of the DCF77 is advanced by 1 hour from the English standard time, a radio controlled timepiece 31 receives the time information that is advanced by 1 hour from the English standard time. However, the time difference setting means 45*b* of the microcomputer 45, as described before, adds the time data P15 that has been received and the time difference data P14, that is stored in the storage circuit 46 together, to output the time setting data P16.

Therefore, the time setting data P16 comes to have a value that is obtained by subtracting 1 hour of the time difference data P14 from the time data P15. As a result, the display part 33 can correctly display the time that has been delayed by 1 hour from the standard time of the DCF77 that has been received, i.e. the time that is equal to the English standard time.

Also, in a case, as well, where the user has returned from England to Germany, it is possible to perform the time difference setting in the same way that has been described in the above-described method. Namely, at the point of time when he has returned from England to Germany, as illustrated in the flow chart of FIG. 10, he depresses the switch S1 by operating the operation button 36 so as to change the normal hand-movement mode to the time difference setting mode that starts at the flow ST3. And, in the flow ST4, the stem 35 is rotated in the direction to 12 o'clock to turn the switch S5 ON, then executes the flow ST11 to thereby add 1 hour to the time difference data P14.

As a result, into the storage circuit 46, there is stored a value that has been obtained by adding +1 hour to the original time difference data P14 and, also, the time keeping means 45*c* of the microcomputer 45 has been added 1 hour thereto. Therefore, the hour hand 33*c* displays the time that has been advanced by 1 hour, i.e. the time that is equal to the German standard time.

Incidentally, since in the storage circuit 46 the time difference data P14 of −1 hour was stored during his stay in England, +1 hour is added to that value, with the result that the time difference data P14 of the storage circuit 46 becomes "zero" time.

Next, a radio controlled timepiece 31 that returned to Germany receives the DCF77. Here, the time correction means 45*b* of the microcomputer 45, as described above, performs addition processing on the time data P15 that is the time information of the DCF77 that has been received and the time difference data P14 that is stored in the storage circuit 46 to thereby output the time setting data P16. However, since the time difference data P14 is zero time as described above, the display part 33 can resultantly display correctly the standard time of the DCF77 that has been received, i.e. the German standard time in the place where the user is now staying.

Next, a second example of the form of use of a radio controlled timepiece 31 that corresponds to a third concrete embodiment of the present invention will be explained. As that second example of the form of use, it is a case where the radio controlled timepiece 31 is unable to receive, or is not receiving, the standard radio wave for some reason or other and where, because the display of the time is incorrect, there has arisen the necessity of adjusting time and calendar through the manual operation.

For example, one case where the user of the radio controlled timepiece 31 has been staying for a large amount of time within a building that the standard radio wave is unable to reach, or an another case, because of immediately after replacing the battery, etc. the user has not received the standard radio wave yet, etc. can be considered as samples. In those cases, the user temporarily manually adjusts time and calendar and later he uses the radio controlled timepiece by performing correct adjustment of time by receiving the standard radio wave.

Here, as the manual time correction operation, the user, first, for adjusting second and minute of the radio controlled timepiece 31, causes the stem 35 to move by pulling it by two steps so as to change the normal hand-movement mode to the second and minute correction mode (namely the operation flow that occurs from the flow ST30 and the successive flows FIG. 11). The user thereby adjusts the minute by rotating stem 35 in the direction to 12 o'clock or 6 o'clock. Next, the user causes the stem 35 to be pulled by one step according to the necessity, so as to change the current mode to the calendar correction mode in which he corrects the month and passed year-of-leap year.

Next, the user returns the stem 35 to the original "zero" step position and operates the operation button 36 and depresses the switch S1 in order to transfer the current mode to the time difference setting mode. As a result, the control is transferred to the flow ST3 illustrated in FIG. 10 to become the time difference setting mode. If in this state by rotating the stem 35 in the direction to 12 o'clock or 6 o'clock, the time difference data P14 is stored into the storage circuit 46 and simultaneously the time data of the time keeping means 45*c* is corrected.

Therefore, the hour hand 33*c* is advanced or delayed at every step by one hour, whereby adjusting time can be performed.

Next, by operating the operation button 37, so that the switch S2 is kept depressed for a long time (for example for 2 seconds or longer). As a result, A radio controlled timepiece 31 can execute the flow ST13 illustrated in FIG. 10 and clear the stored content of the storage circuit 46 and make the value of the time difference data P14 zero to thereby invalidate the time difference data P14 that was input. However, even by performing the operation for erasing or clearing the time difference data in the flow ST13, the time that is displayed on the display part 33 is not restored to the time that the timepiece immediately precedingly received. The display part 33 instead maintains the display thereon that has been made of the time that was set in the flow ST11 or flow ST12.

By performing the above-described operation, in a next case when A radio controlled timepiece 31 receives the standard radio wave to automatically corrects time, since the time difference data P14 that is stored in the storage circuit 46 is made invalid, the time data P15 that has been acquired by reception is not corrected by the time difference data P14 but the timepiece 31 can make a correct display of the standard time that has been received. Also, conversely, in a case when A radio controlled timepiece 31 has not been able to succeed in making the next-time reception (or has not executed the receiving operation), the user can utilize A radio controlled timepiece by setting for current time that is done through the manual operation in the flow ST11 or flow ST12.

Through his above-described operation, the user can simply correct time and calendar by his manual operation even when the displayed time of A radio controlled timepiece 31 is out of correct order. Incidentally, the procedure for correction is not limited to the above-described procedure. For example, after correction of time by executing the time difference setting mode, the user may transfer to the calendar correction mode and then transfer to the second and minute correction mode.

As described above, according to the respective embodiments of the second concrete example of the present invention, under the normal hand-movement mode, by simply depressing the operation button 36, this operation the current mode to transfer to the time difference setting mode and enables time difference setting to be performed with units of an hour by operating the stem 35. Therefore, even when the user of the radio controlled timepiece has moved to a country or region where the time difference is different, he can simply and quickly perform the time difference setting, thereby there can be realized the radio controlled timepiece having a high operation efficiency. Also, in both a case where an operation for setting for time difference is performed and a case where a time correcting operation is manually performed, since the user can cause the current mode to transfer to the time difference setting mode or time correction mode by operating the same operation button (for example the operation button 36), it is possible to provide the radio controlled timepiece that involves therein a consistency in the flow of correction operation and the operation of that is simple and easy to understand.

Further, in a case when manually performing time correction is performed, the time difference data P14 stored can be cleared and invalidated by one operation (for example the long depression of the operation button 37). Therefore, even if the standard radio wave could be received later, the user can automatically correct the time correctly to the standard time of the standard radio wave that he has received. Thus, it is possible to reliably separate the setting for time difference and the time correction from each other. As a result, it is possible to provide the radio controlled timepiece that, in whatever form of use the timepiece is used, enables always correctly displaying time and that, therefore, has a high level of reliability.

Figure 12:
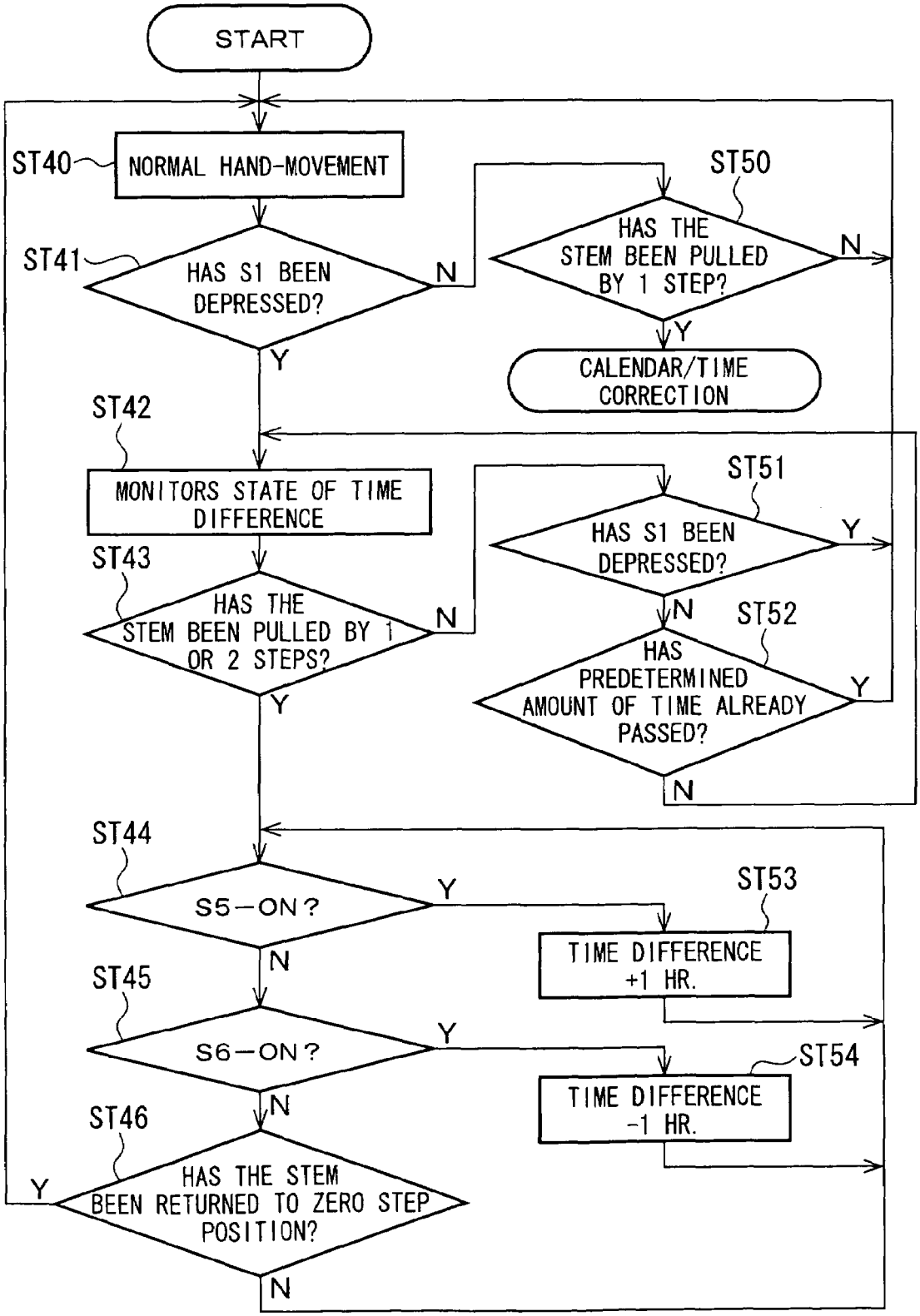
FIG. 12 is a flow chart illustrating a time difference setting method for A radio controlled timepiece according to a second embodiment of the present invention.
Figure 13:
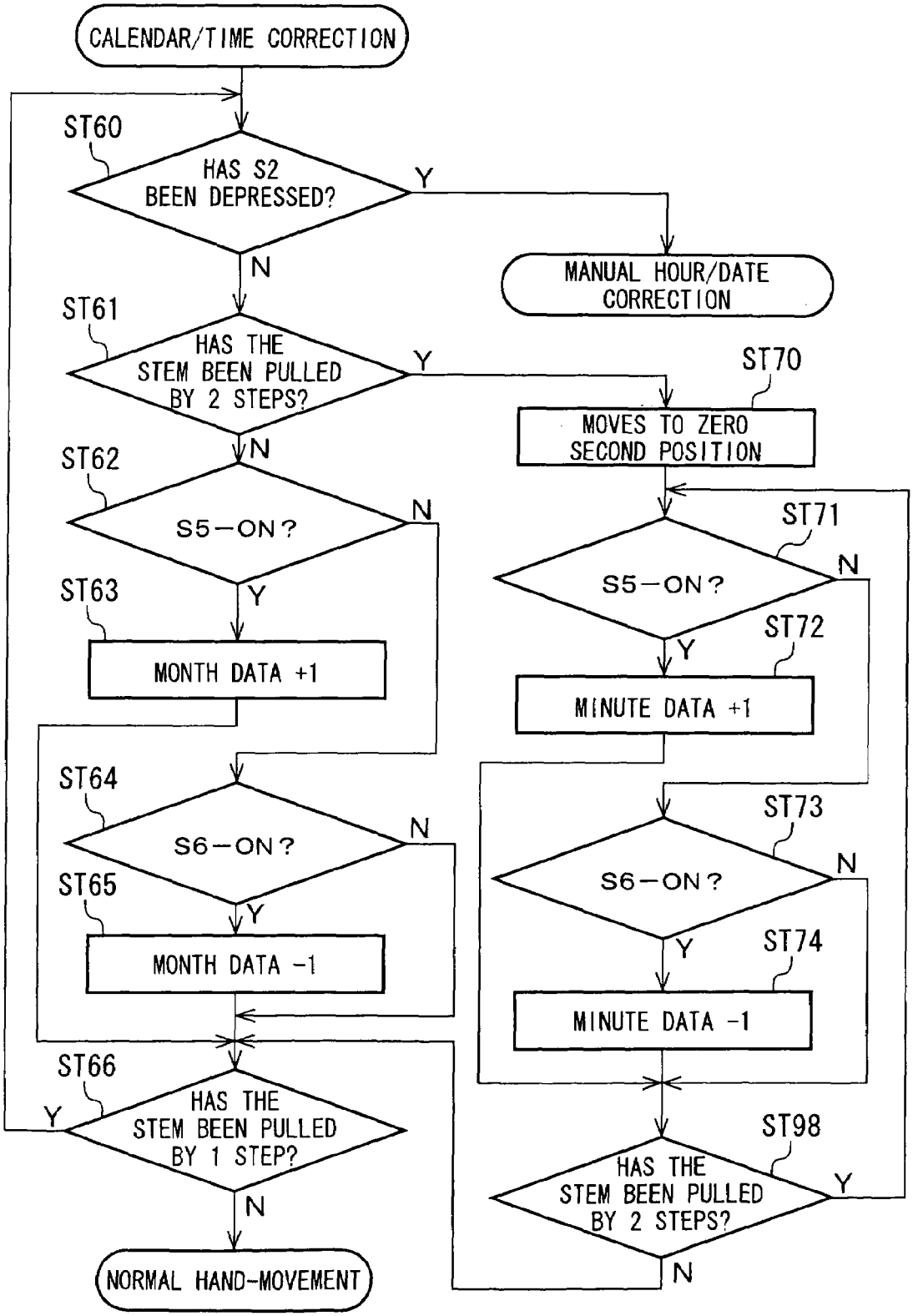
FIG. 13 is a flow chart illustrating a calendar/sec. and min. correcting method for A radio controlled timepiece according to the second embodiment of the present invention.
Figure 14:
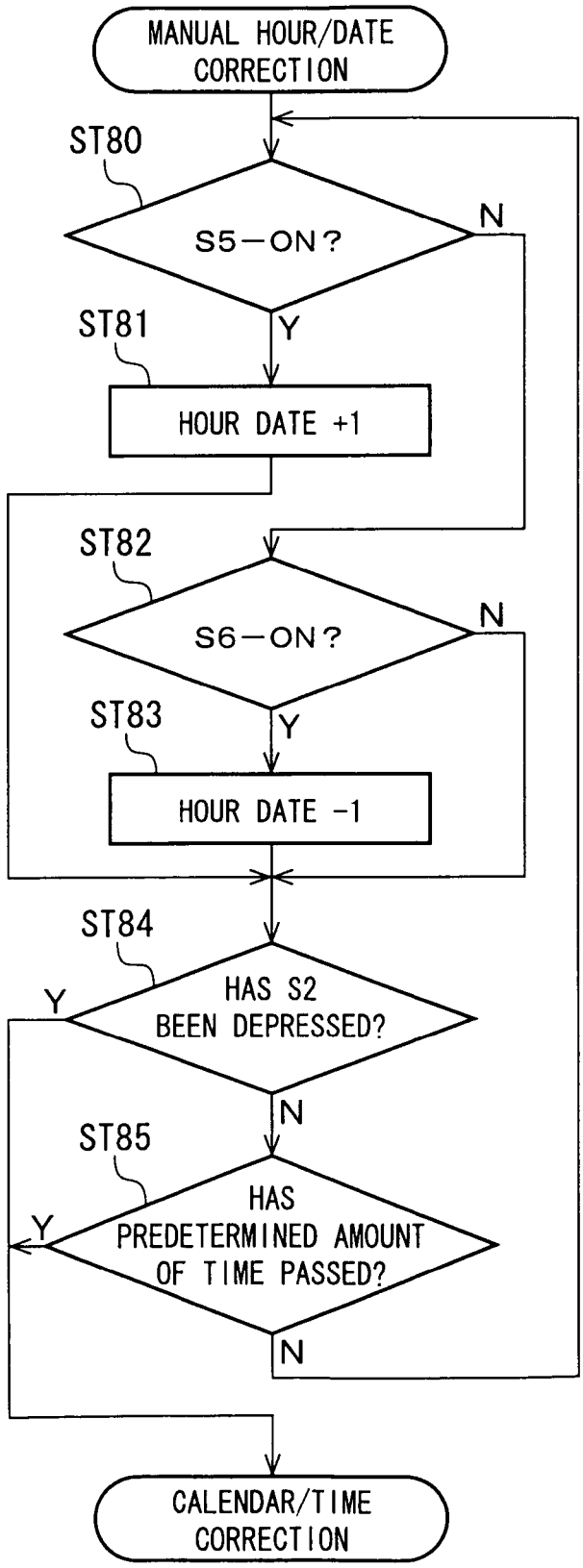
FIG. 14 is a flow chart illustrating a time/date correcting method for A radio controlled timepiece according to the second embodiment of the present invention.
Figure 16:
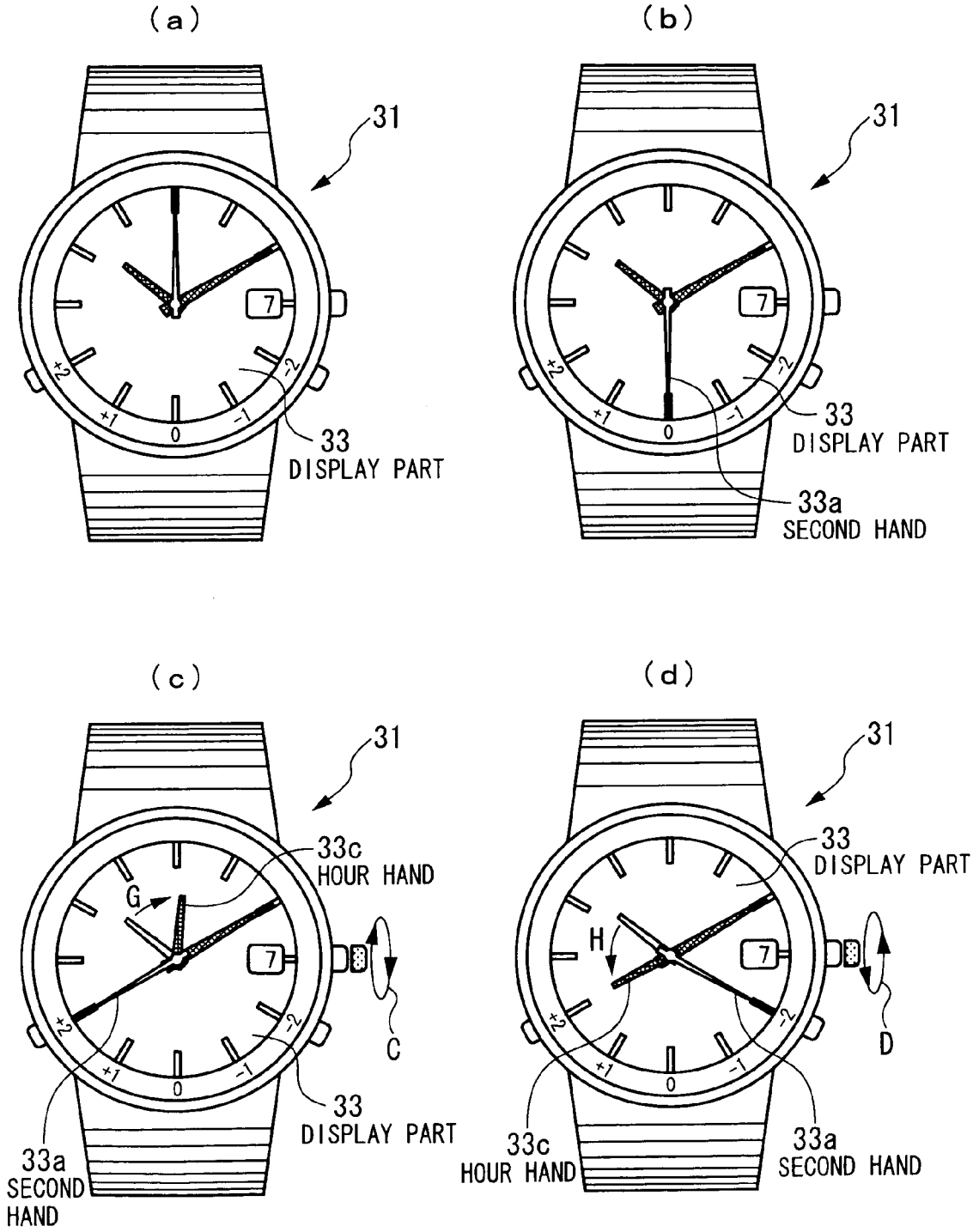
FIGS. 16(*a*), 16(*b*), 16(*c*), and 16(*d*) are explanatory views illustrating a state of display that comes up in a time difference setting mode for A radio controlled timepiece according to the second embodiment of the present invention.

Next, a time difference setting method as well as a calendar/time correction method for the radio controlled timepiece 31 according to a third concrete example of the present invention will be explained with reference to FIGS. 12 to 14 as well as FIG. 16. FIG. 12 is a flow chart illustrating a time difference setting method; FIG. 13 is a flow chart illustrating a manual calendar/second and minute correction method; and FIG. 14 is a flow chart illustrating an hour/date correction method that is manually executed. Also, FIG. 16 illustrates the displayed state of the display part 33 of the radio controlled timepiece 31 that is in the time difference setting mode according to a second embodiment of the present invention. The third concrete example will be explained inclusive of this FIG. 16.

In FIG. 12, the radio controlled timepiece 31 is performing the normal hand-movement operation at every second (flow ST40).

FIG. 16(*a*) illustrates the displayed state of the display part 33 during the normal hand-movement operation and, as an example, is displaying a state of 10 (hour):10 (minute):00 (second) a.m. and a 7th day as the date. Incidentally, in the normal hand-movement in the flow ST40, it is premised that the stem 35 is located at the position of zero steps (namely the switches S3 and S4 are both "OFF"). Also, in the normal hand-movement at this stage, there can be assumed two cases, in one of that a standard radio wave is received and accurate time is being carried by the hands in correct synchronism with the standard time and in the other of that hand-movement is being made in a state where, for some reason or other, the timepiece is unable to receive the standard radio wave, or the timepiece is not receiving the standard radio wave.

Next, the microcomputer 45 inputs the switch signal P1 and knows the state of the switch S1 and determine whether or not the switch S1 is depressed. When "YES" is made (namely the operation button 36 is depressed), the control proceeds to a flow ST42, whereas, when "NO" is made, the control proceeds to a flow ST50 (flow ST41). Here, the switch S1 functions as a switch for causing transferring the flow to the time difference setting mode and, after the flow ST42, the time difference setting mode becomes executed.

Hereinafter, the operation flow from the flow ST42 and its successive flows, namely in the time difference setting mode, will be explained. Here, when the radio controlled timepiece 31 is transferred to the time difference setting mode, for monitoring the state of time difference the second hand 33*a* is moved according to the time difference that is already set to thereby display to the user the set state of time difference that is currently set (flow ST42).

Explaining an example, in a case when the time difference that is set is zero, the second hand 33*a* is moved to the position of 30 seconds; in a case when the time difference that is set is +1 hour, the second hand 33*a* is moved to the position of 35 seconds; and in a case when the time difference that is set is +2 hour, the second hand 33*a* is moved to the position of 40 seconds.

Also, in a case when the time difference that is set is −1 hour, the second hand 33*a* is moved to the position of 45 seconds, while, in a case when the time difference that is set is −2 hour, the second hand 33*a* is moved to the position of 20 seconds. Incidentally, in order to give the user this monitored state of time difference for the user to understand its state easily, as illustrated in FIG. 16, if −2, −1, 0, +1, and +2 are marked on the outer peripheral portion of the display part 33 of the radio controlled timepiece 31, the user can easily understand the setting situation about the time difference.

FIG. 16(*b*) illustrates an example of the monitored state of time difference. Here, the time difference is not set and is zero, and, therefore, the second hand 33*a* is moved to the position of the time difference of 0, namely, the position of 30 seconds. It is to be noted that the configuration as illustrated in FIG. 16(*b*) wherein the state of time difference is monitored is not limited thereto. The method for monitoring may be arbitrary.

Next, the microcomputer 45 inputs the switch signals P3 and P4 and detects the states of the switch S3 and switch S4 and determines whether or not the switch S3 or S4 has been turned ON (namely whether or not the stem 35 has been pulled by one step or by two steps). When "YES" is made, the control proceeds to a flow ST44, whereas, when "NO" is made, the control proceeds to a flow ST51 (flow ST43).

Next, an explanation will be given to the time difference setting method that is executed by rotating the stem 35. The microcomputer 45 input the switch signal P5 and knows the state of the switch S5 that is turned ON interlockingly with the rotation of the stem 35 in the direction to 12 o'clock and determines whether or not the switch S5 has been turned ON.

When "YES" is made (namely the stem 35 has been rotated in the direction to 12 o'clock), the control proceeds to a flow ST53, whereas, when "NO" is made, the control proceeds to the next flow ST45 (flow ST44).

When "YES" is made in the flow ST44, the microcomputer 45 adds 1 hour to the time difference data P14 to store the time difference data P14 that has been updated into the storage circuit 46 and simultaneously also adds 1 hour to the time keeping means 45*c* (flow ST53). Here, since 1 hour is added to the time keeping means 45*c*, the time keeping data P13 becomes from 10 (hour):10 (minute) a.m. to 11 (hour):10 (minute) a.m. As a result, the hour hand 33*c* of the display part 33 that is driven by time keeping data P13 is moved to the time position that has been advanced by 1 hour. Also, as a result of the fact that 1 hour has been added to the time difference, the second hand 33*a* that serves to monitor the state of time difference is moved to the position having a time difference of +1 (namely the position of 35 seconds). Incidentally, after executing the flow ST53, the control is returned to the flow ST44, whereby the determination on the switch S5 is repeatedly executed.

As a result, if the user continuously rotates the stem 35 in the direction to 12 o'clock, the flow ST53 is continuously executed, whereby the time difference data P14 is continuously added thereto and it is stored in the storage circuit 46.

Simultaneously, the second hand 33*a* that serves to monitor the state of time difference indicates the set state of time difference and the hour hand 33*c* also repeatedly performs its advancing motion with units of an hour. FIG. 16(*c*) illustrates a state where, the stem 35 is pulled by one step and thereafter it is rotated in the direction shown by an arrow C (namely the direction to 12 o'clock), the time difference of 2 hours is added thereto with the result that the hour hand 33*c* is advanced by 2 hours as indicated by the arrow G, thereby the time display has been brought to a state of 12 (hour):10 (minute) p.m. Also, the second hand 33*a* that serves to monitor the state of time difference is moved to the position having a time difference of +2 to indicate the set amount of time difference.

Next, when "NO" is made in the flow ST44, the microcomputer 45 inputs the switch signal P6 and knows or detects the state in that the switch S6 that is turned ON interlockingly with the rotation of the stem 35 in the direction to 6 o'clock and determines whether or not the switch S6 has been turned ON. When "YES" is made (namely the stem 35 has been rotated in the direction to 6 o'clock), the control proceeds to a flow ST54, whereas, when "NO" is made, the control proceeds to a flow ST46 (flow ST45).

When "YES" is made in the flow ST45, the microcomputer 45 subtracts 1 hour from the time difference data P14 to store the time difference data P14 that has been updated into the storage circuit 46 and simultaneously also subtracts 1 hour from the time keeping means 45*c* (flow ST54). Here, since 1 hour is subtracted from the time keeping means 45*c*, the time keeping data P13 is changed from 10 (hour):10 (minute) a.m. to 9 (hour):10 (minute) a.m. As a result, the hour hand 33*c* of the display part 33 that is driven by the time keeping data P13 is moved to the time position that has been delayed by the extent of 1 hour. Also, as a result of the fact that 1 hour has been subtracted from the time difference, the second hand 33*a* that serves to monitor the state of time difference is carried to the position having a time difference of −1 (namely the position of 45 seconds). Incidentally, after executing the flow ST54, the control is returned to the flow ST44, whereby the determination on the switch S5/S6 is repeatedly executed.

As a result, if the user continuously rotates the stem 35 in the direction to 6 o'clock, the flow ST54 is continuously executed, whereby the time difference data P14 is continuously subtracted therefrom and that time difference data P14 is stored into the storage circuit 46. Simultaneously, the second hand 33*a* that serves to monitor the state of time difference indicates the set state of time difference and the hour hand 33*c* also repeatedly performs its delaying motion in units of an hour.

FIG. 16(*d*) illustrates a state where, the stem 35 is pulled out with one step and it is rotated in the direction D as shown by an arrow D (namely the direction to 6 o'clock), the time difference of 2 hours is subtracted with the result that the hour hand 33*c* is delayed by 2 hours as indicated by the arrow H, thereby the time display has been brought to a state of 8 (hour):10 (minute) p.m. Also, the second hand 33*a* that serves to monitor the state of time difference is moved to the position having a time difference of −2 to indicate the set amount of time difference.

Next, when "NO" is made in the flow ST45, the microcomputer 45 inputs the switch signals P3 and P4 and knows the state of the switches S3 and S4 and determines whether or not the switches S3 and S4 have been turned OFF (namely the stem 35 has been returned to the zero step position). When "YES" is made, the control proceeds to the flow ST40 for normal hand-movement, whereas, when "NO" is made, the control is returned to the flow ST44, in which determination on the switches S5 and S6 is repeatedly executed (flow ST46).

Next, the flow that follows the flow ST51 will be explained. When "NO" is made in the flow ST43, the microcomputer 45 inputs the switch signal P1 and knows the state of the switch S1 and determines whether or not the switch S1 has been turned ON. When "YES" is made (namely the operation button 36 has been depressed), the control is returned to the flow ST40 for the normal hand-movement, whereas, when "NO" is made, the control proceeds to the next flow ST52 (flow ST51). Namely, when, during monitoring the state of time difference in the flow ST42, the switch S1 is again depressed by the operation button 36 without pulling the stem is, the control is returned to the normal hand-movement.

Next, when "NO" is made in the flow ST51, the microcomputer 45 checks the value of the built-in timer (not illustrated) and determines whether or not the predetermined elapsed time has been passed. When "YES" is made, the control is returned to the normal hand-movement in the flow ST40, whereas, when "NO" is made, the control is returned to monitoring the state of time difference in the flow ST42 (flow ST52). Here, since the built-in timer of the microcomputer 45 counts down when all the switches S1 to S6 are in their OFF state, the flow ST52 operates as an auto-return function whereby the current mode can automatically returned to the normal hand-movement operation with the user continues a condition in which no operation is performed for a predetermined period, under the time difference state monitoring mode.

Here, when after finishing the time difference setting mode whereby the control has been returned to the normal hand-movement and thereafter receiving the standard radio wave, the time setting data P16 that is input to the time keeping means 45*c* of the microcomputer 45, as in the first embodiment, becomes the value that has obtained by adding thereto the time data P15 obtained by receiving the standard radio wave and the time difference data P14 of the storage circuit 46 by the operation of the time correction means 45*b*. As a result, the time that is displayed on the display part 33 becomes a time that is obtained by adding the time difference data P14 to the standard time that has been received. Namely, the displayed time is corrected by the time difference data P14 that has been set.

Next, when "NO" is made in the flow ST41, the microcomputer 45 inputs the switch signal P3 and knows the state of the switch S3 and determines whether or not the switch S3 has been turned ON (namely the stem 35 has been pulled by one step). When "YES" is made, the control is transferred to the calendar/time correction mode, whereas, when "NO" is made, the control is returned to the normal hand-movement in the flow ST40 (flow ST50).

Next, the calendar/time correction method will be explained with reference to FIG. 13. When "YES" is made in the flow ST50, the control is transferred to the calendar/time correction mode that is executed from the flow ST60 and its successive flows, that is illustrated in FIG. 13. Here, the microcomputer 45 inputs the switch signal P2 and knows the state of the switch S2 and determines whether or not the switch S2 has been turned ON (namely the operation button 37 has been operated). When "YES" is made, the control proceeds to a manual hour/date correction mode, whereas, when "NO" is made, the control proceeds to a flow ST61 (flow ST60).

Next, when "NO" is made in the flow ST60, the microcomputer 45 inputs the switch signal P4 and knows the state of the switch S4 and determines whether or not the switch S4 has been turned ON (namely the stem 35 has been pulled by two steps). When "YES" is made, the control is transferred to a flow ST70 for executing the second/minute correction mode, whereas, when "NO" is made, the control proceeds to a flow ST62 for executing a calendar correction mode (flow ST61).

Next, the calendar correction mode in a case when "NO" is made in the flow ST61 will be explained. The microcomputer 45 inputs the switch signal P5 and knows the state of the switch S5 and determines whether or not the switch S5 has been turned ON. When "YES" is made (namely the stem 35 has been rotated in the direction to 12 o'clock), the control proceeds to a flow ST63, whereas, when "NO" is made, the control proceeds to a flow ST64 (flow ST62).

When "YES" is made in the flow ST62, the microcomputer 45 adds +1 to the month data of the time keeping means 45*c* of the microcomputer 45 and the second hand 33*a* moves to the month display position that is predetermined although not illustrated by the time keeping data P13 that is the output of the time keeping means 45*c* (flow ST63). Although the detail is omitted, it may be arranged that not only the correction of month but also the correction of the passed years that have lapsed from a relevant leap year be executed. Incidentally, after executing the flow ST63, the control proceeds to a flow ST66 that will be described later.

Next, when "NO" is made in the flow ST62, the microcomputer 45 inputs the switch signal P6 and knows the state of the switch S6 and determines whether or not the switch S6 has been turned ON. When "YES" is made (namely the stem 35 has been rotated in the direction to 6 o'clock), the control proceeds to a flow ST65, whereas, when "NO" is made, the control proceeds to a flow ST66 that will be described later (flow ST64).

When "YES" is made in the flow ST64, the microcomputer 45 subtracts −1 from the month data of the time keeping means 45*c* and the second hand 33*a* moves to the month display position that is predetermined although not illustrated by the time keeping data P13 that is the output of the time keeping means 45*c* (flow ST65). Although the detail is omitted, it may be arranged that not only the correction of month but also the correction of the passed years that have lapsed from a relevant leap year be executed. Incidentally, after executing the flow ST65, the control proceeds to a flow ST66 that will be described later.

Next, after finishing the flow ST63 and flow ST65, when "NO" is made in the flow ST64, the microcomputer 45 inputs the switch signal P3 and knows the state of the switch S3 and determines whether or not the switch S3 has been turned ON (namely the stem 35 has been pulled by one step or not). When "YES" is made, the control is returned to the flow ST60, whereas, when "NO" is made, the control finishes the current calendar/time correction mode and is returned to the normal hand-movement (flow ST66).

Next, the second and minute correction mode that the control is about to be transferred when "YES" determination has been made in the flow ST6 will be explained. The microcomputer 45 resets the second data of the time keeping data P13 to zero second and thereby moves the second hand 33*a* to the zero second position (flow ST70).

Next, the microcomputer 45 inputs the switch signal S5 and knows the state of the switch S5 and determines whether or not the switch S5 has been turned ON. When "YES" is made (namely the stem 35 has been rotated in the direction to 12 o'clock), the control proceeds to a flow ST72, whereas, when "NO" is made, the control proceeds to a flow ST73 (flow ST71).

When "YES" is made in the flow ST71, the time keeping means 45*c* of the microcomputer 45 adds +1 to the minute data of the time keeping means 45*c* and advances the minute hand 33*b* (not Shown) by 1 minute by the time keeping data P13 that is the output of the time keeping means 45*c* although not illustrated (flow ST72). Incidentally, after finishing the flow ST72, the control proceeds to a flow ST98.

Next, when "NO" is made in the flow ST71, the microcomputer 45 inputs the switch signal P6 and knows the state of the switch S6 and determines whether or not the switch S6 has been turned ON. When "YES" is made (namely the stem 35 has been rotated in the direction to 6 o'clock), the control proceeds to a flow ST74, whereas, when "NO" is made, the control proceeds to a flow ST98 (flow ST73).

When "YES" is made in the flow ST73, the microcomputer 45 subtracts −1 from the minute data of the time keeping means 45*c* and delays the minute hand 33*b* by 1 minute although not illustrated by the time keeping data P13 that is the output of the time keeping means 45*c* (flow ST74). Incidentally, after finishing the flow ST74, the control proceeds to a flow ST98.

Next, the microcomputer 45 inputs the switch signal P4 and senses the state of the switch S4 and determines whether or not the switch S4 has been turned ON (namely the stem 35 has been pulled by two steps). When "YES" is made, the control proceeds to the flow ST71, whereas, when "NO" is made, the control proceeds to the flow ST66 (flow ST98). As a result, when, at the point of time when correction of the minute hand 33*b* has finished, if the stem 35 is returned to the zero step position according to the zero second at the standard time that is transmitted over a relevant telephone, "NO" is made in both the flow ST98 and flow ST66, whereby the control is returned to the normal hand-movement. Therefore, it is possible to perform accurate time adjustment for the second hand 33*a*.

Next, the manual hour/date correction method will be explained with reference to FIG. 14. In the flow ST60, when "YES" is made, in the flow 80, the microcomputer 45 inputs the switch signal P5 and knows the state of the switch S5 and determines whether or not the switch S5 has been turned ON. When "YES" is made (namely the stem 35 has been rotated in the direction to 12 o'clock), the control proceeds to a flow ST81, whereas, when "NO" is made, the control proceeds to a flow ST82 (flow ST80).

When "YES" is made in the flow ST80, the microcomputer 45 adds +1 to the hour data of the time keeping means 45*c* and advances the hour hand 33*c* by 1 hour although not illustrated by the time keeping data P13 that is the output of the time keeping means 45*c*. Also, when the gear train mechanism (not illustrated) built in the display part 33 operates to move the hour hand 33*c* reaches at the neighborhood of zero time before noon, the date display part 33*d* is advanced by 1 day (flow ST81) Incidentally, after executing the flow ST81, the control proceeds to a flow ST84 that will be described later.

Next, when "NO" is made in the flow ST80, the control proceeds to a flow ST82 and the microcomputer 45 inputs the switch signal P6 and knows the state of the switch S6 and determines whether or not the switch S6 has been turned ON. When "YES" is made (namely the stem 35 has been rotated in the direction to 6 o'clock), the control proceeds to a flow ST83, whereas, when "NO" is made, the control proceeds to a flow ST84 (flow ST82).

When "YES" is made in the flow ST82, the microcomputer 45 subtracts −1 from the hour data of the time keeping means 45*c* and delays the move of the hour hand 33*c*, although not illustrated, by 1 hour by the time keeping data P13 that is the output of the time keeping means 45*c* (flow ST83). Incidentally, after finishing the flow ST83, the control proceeds to a flow ST84.

Next, the control that is executed from the flow ST84 and its successive flows, will be explained. After finishing the flow ST81 and flow ST83, or when "NO" is made in the flow ST82, the microcomputer 45 inputs the switch signal P2 and knows the state of the switch S2 and determines whether or not the switch S2 has been depressed. When "YES" is made (namely the operation button 37 has been depressed). The control is returned to the flow ST60 for calendar/time correction mode, whereas, when "NO" is made, the control proceeds to the next flow ST85 (flow ST84)

Next, when "NO" is made in the flow ST84, the microcomputer 45 checks the value of the built-in timer (not illustrated) and determines whether or not a predetermined elapsed time has passed.

When "YES" is made, the control is returned to the flow ST60 for the calendar/time correction mode, whereas, when "NO" is made, the control is returned to the flow ST80 that is the leading flow for the manual hour/date correction mode (flow ST85).

Incidentally, in a case when in the manual hour/date correction mode, the time has been corrected only the addition or subtraction of the time data is executed to the time keeping means 45*c* of the microcomputer 45. And neither addition nor subtraction is executed with respect to the storage circuit 46 that stores the time difference data P14, whereby the time difference data P14 has maintained its initial value (namely zero hour) as it is. For this reason, in a case when, after finishing the manual hour/date correction mode, the standard radio wave has been received, although the time data P15 and the time difference data P14 of the storage circuit 46 are added together by the operation of the time difference correction means 45*b*, so that the time setting data P16 is output, since as described above the time difference data P14 is maintained at zero hour, the time data P15 that has been obtained by reception is input as the time setting data P16 into the time keeping means 45*c* without being corrected by the time difference data P14.

And, as a result of this, on the display part 33 there is displayed the standard time of the standard radio wave that has been received.

Incidentally, the input operation system that, in the third concrete example, is executed in the time difference setting mode and to which the current normal hand-movement mode is shifted after depressing the operation button 36 corresponds to the first input operation system that is defined by the claims of the present invention. Also, the input operation system that is executed in the manual hour/date correction mode and to which the current mode is shifted after depressing the operation button 37 under the state in that the stem 35 is pulled by 1 step, corresponds to the second input operation system that is defined in by the present invention. Also, the input operation system that is executed in the second/minute correction mode to which the current mode is shifted by pulling the stem 35 by two steps, corresponds to the third input operation system that is defined in the present invention.

As described above, according to the third concrete embodiment of the present invention, the operation systems for performing the time different setting operation and for performing the time correction operation are different from each other. For example, for the shifting operation from a current mode to the time difference setting mode that becomes needed to be performed as a result of the user having moved from one or region to another, this shifting operation is performed by depressing the operation button 36, while, on the other hand, for the shifting operation from a current mode to the manual time correction mode, this shifting operation is performed by pulling the stem manually.

As, mentioned above, in the present invention, the above-mentioned two operation systems are separately configured so as to have the respective operational way which being different from each other with respect to an object to be used.

Therefore, it is possible to provide the radio controlled timepiece that is easily understandable for the user and that is easy to use.

Also, transferring to the time difference setting mode, as in the case of the first embodiment of the present invention can be realized by simply depressing the operation button 36 while the control is during the normal hand-movement, whereby it is possible to perform setting for time difference with units of an hour by operating the stem 35. Therefore, it is possible to realize a radio controlled timepiece wherein, even in a case when the user of the radio controlled timepiece has moved to a country or a region where the time difference is different, he can simply and quickly perform the setting for time difference and which has excellent operating efficiency.

Also, correcting the month, hour and data, and second and minute can be performed by their respective different operation systems, such as, in the way that, in the manual calendar/time correction, correcting the month and the passed years of a relevant leap year is performed by pulling the stem 35 by one step, correcting the hour is performed after depressing the operation button 37 by pulling the stem 35 by one step, and further correcting the second is performed by pulling the stem 35 by two steps. Therefore, it is possible to provide the radio controlled timepiece that enables shortening the correcting amount of time and, even when correcting the time manually, has excellent operation efficiency.

Figure 17:
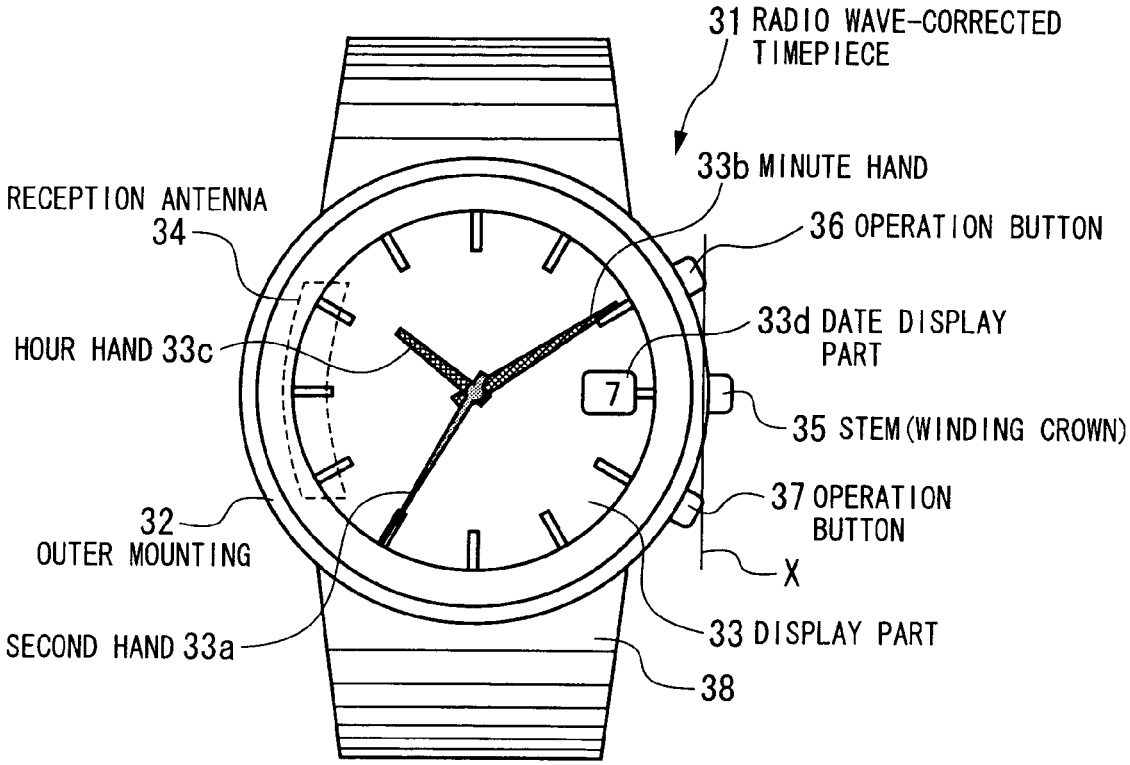
FIG. 17 is an explanatory view illustrating A radio controlled timepiece according to another embodiment of the present invention.

Next, a radio controlled timepiece that is a fourth concrete embodiment of the present invention will be explained with reference to FIG. 17. In FIG. 17, a reference numeral 31 denotes a radio controlled timepiece that is the fourth concrete example of the present invention and the same elements as those of the radio controlled timepiece 31 illustrated in FIG. 8 are denoted by like numerals with a duplex explanation being omitted.

Here, the reception antenna 34 is disposed in the direction to substantially 9 o'clock inside the outer mounting 2, while the operation button 36 is disposed in the direction to substantially 2 o'clock of the outer mounting 2. Also, the operation button 37 is disposed in the direction to substantially 4 o'clock of the outer mounting 2. By disposing the reception antenna 34 at the positions where the reception antenna 34 and the operation buttons 36 and 37 are opposed to each other, namely specifically the area that is on a side that is opposite, with respect to a line that is parallel with the line (solid line X) connecting the operation buttons 36 and operation button 37 the line (solid line X) connecting the operation buttons 36 and operation button 37 and that passes through the movement at the center, to the area having that solid line X, it is possible to make small the size of the radio controlled timepiece.

Incidentally, although the respective concrete examples of the present invention are directed to providing the radio controlled timepiece with a motor system of one motor for display of second/minute and two motors for display of hour and day, that concrete example is not limited thereto. For example, even when the motor system is of two-motor type, it may be constructed with one motor for display of second/minute/hour and another motor for display of day. Also, the motor system may be constructed with one motor for display of second and another motor for display of minute/hour and day. In addition, the motor system is not limited to the two-motor type system but may be constructed as a three-motor type system.

For example, the motor system may be a type constructed with a first motor for display of second, a second motor for display of minute and hour, and a third motor for display of day. Further, the motor system may be a type constructed with a first motor for display of second and minute, a second motor for display of hour, and a third motor for display of day. Further, the motor system may be a type constructed with a first motor for display of second, a second motor for display of minute, and a third motor for display of hour and day. In this case, the motor system can be constructed so that it drives displaying each second, minute, hour, and day through driving it by a relevant one motor.

Also, although the circuit construction of the present invention illustrated in FIG. 9 has been made using the microcomputer 45 in terms of its control system, the invention is not limited thereto. For example, the respective control functions may be constructed by hardware and the relevant circuit may be thereby realized without using the microcomputer. Also, although the storage circuit 46 has been disposed outside the microcomputer 45, the invention is not limited thereto but that circuit 46 may be built into that microcomputer. In addition, although the stem 35 that is of a rotatable type has been used as the input means, the invention is not limited to that inputting system, either. For example, a number of operation buttons may be disposed on the peripheral part of the outer piece of mounting 2 to provide the respective operation buttons with their respective specific functions.

Also, the respective flow charts illustrated as the embodiments of the present invention are not limited thereto. But, if satisfying the respective functions, the operation flows can arbitrarily be set. Also, although the time difference data P14 stored into the storage circuit 46 has been prepared in units of an hour, the invention is not limited to that value but permits that data P14 to be in units of, for example, 5 minutes or 10 minutes. And, if it is arranged that, for allowing the user to have some room for acquiring a surplus amount of time not for allowing realizing the concept "correction for time difference", a value of, for example, 10 minutes be stored in the storage circuit 46, the radio controlled timepiece 31 can display with respect to the received standard time the time that is always kept advanced by the 10-minute amount of time.

Incidentally, although, in each of the above-described first to fourth concrete examples of the present invention, the radio controlled timepiece of analog display type has been described, the invention is not limited thereto and the radio controlled timepiece may be of digital display type, or of a composite display type of analog type and digital type. Also, the controlling method of the present invention is not limited to a timepiece but can widely be applied to various electronic appliances having the radio controlled timepiece function.

As will be apparent from the foregoing explanation, according to each of the second to fourth concrete examples of the present invention, it is possible to input time difference information in units of an hour through performing a simple operation and store it and display the standard time of the standard radio wave that has been received in the way that it reflects the time difference information that has above been stored. Therefore, even if the user of the radio controlled timepiece moves to a country or region where the time difference is different, it is possible to accurately and quickly display time corresponding to the standard time in that country or region.

Therefore, it is possible to provide the radio controlled timepiece having excellent operating efficiency and a high reliability.

What is claimed is:

1. A radio controlled timepiece, which comprises:

a reference signal generating means that outputs a reference signal;

a time keeping means that outputs time keeping information based upon said reference signal;

a display means that displays time information based upon said time keeping information; and a receiving means that receives a standard radio wave having time information, whereby output time information output from said time keeping means can be corrected based upon a reception signal output from said receiving means, and wherein said radio controlled timepiece further comprises:

an offset time difference information storage means that stores an offset time difference formed between a certain region and a particular region where said standard radio wave has been received, by setting a time information in said certain region as a standard time information;

a daylight saving time information storage means that stores therein information whether or not a daylight saving time is executed in the region where said standard radio wave has been received;

a local standard time information forming means that executes an operational processing by utilizing said offset time difference information formed between said time information of said standard radio wave as received in said particular region and said standard time information, and said daylight saving time information used in said particular region, so as to form said local standard time information in said particular region; and a time difference correction history information storage means that stores information on whether or not a user has manually corrected time difference information, and wherein said radio controlled timepiece is configured so that when said radio controlled timepiece has received said standard radio wave, said offset time difference of said offset time difference information storing means is adjusted by utilizing said information of said time difference correction history information storage means, said daylight saving time information stored in said daylight saving time information storage means as obtained when said standard radio wave has been received at an immediately preceding sampling period, and said daylight saving time information as obtained when said standard radio wave has been received at the present sampling period, and then said local standard time information of said local standard time information forming means is adjusted based upon said adjusted offset time information and said daylight saving time information as obtained when said standard radio wave has been received at the present sampling period.

2. A radio controlled timepiece according to claim 1, wherein said timepiece is configured so that when a fact that a user has manually performed said time difference correction operation, is stored in said time difference correction history information storage means and then said standard radio wave has been received at the present sampling period, and in a case wherein said daylight saving time information as stored in said daylight saving time information storing means when said standard radio wave has been received at an immediately preceding sampling period, and said daylight saving time information as obtained when said standard radio wave has been received at the present sampling period, are different from each other, said offset time difference of said offset time difference information storing means is adjusted.

3. A radio controlled timepiece according to claim 2, wherein in a case when said daylight saving time information stored in said daylight saving time information storing means shows that said daylight saving time was effective at the time when said standard radio wave has been received at an immediately preceding sampling period, while said daylight saving time information stored in said daylight saving time information storing means shows that said daylight saving time was not effective at the present sampling period, said offset time difference of said offset time difference information storing means is adjusted by adding one hour to said offset time difference.

4. A radio controlled timepiece according to claim 2, wherein in a case when said daylight saving time information stored in said daylight saving time information storing means shows that said daylight saving time was not effective at the time when said standard radio wave has been received at an immediately preceding sampling period, while said daylight saving time information stored in said daylight saving time information storing means shows that said daylight saving time was effective at the present sampling period, said offset time difference of said offset time difference information storing means is adjusted by subtracting one hour from said offset time difference.

5. A radio controlled timepiece according to claim 1, wherein said timepiece is configured so that when a fact that a user has manually performed said time difference correction operation, is stored in said time difference correction history information storage means and then said standard radio wave has been received at the present sampling period, and in a case wherein said daylight saving time information as stored in said daylight saving time information storing means at an immediately preceding sampling period and said daylight saving time information as obtained when said standard radio wave has been received at the present sampling period, are the same as each other, said offset time difference of said offset time difference information storing means is not adjusted.

6. A radio controlled timepiece according to any one of the claims 1 to 5, wherein said local standard time information is displayed on said display means.

7. A radio controlled timepiece according to any one of claims 1 to 5, wherein said timepiece is further provided with a reference time information storage means which adjusts a time information in a certain region with reference to a time information of a standard radio wave as received, and stores it therein as a standard time information.

8. A radio controlled timepiece according to any one of claims 1 to 5, wherein said reference time information is universal standard time information.

9. A radio controlled timepiece according to claim 7, wherein said reference time information is said local standard time information used in said particular region.

10. A radio controlled timepiece according to claim 1, wherein said receiving means comprises an automatic selective-reception control means for executing a control for enabling the reception means to automatically and selectively receive either one of a first standard radio wave including first reference time information or a second standard radio wave including second time information, whereby it is configured so that in a case when it recognizes that said first standard radio wave has been received, a first time difference data is set at said offset time difference information storage means, while, in a case when it recognizes that said second standard radio wave has been received, second time difference data is set at said offset time difference information storage means.

11. A radio controlled timepiece according to claim 10, wherein said receiving means further comprises a received radio wave belonging country name storage means that stores the country name information that has been recognized from a received standard radio wave received according to said automatic selective-reception control means and said timepiece is configured so that, in a case when said received standard radio wave has been changed, at least one of said offset time difference information stored in said offset time difference storage means in the particular region and daylight saving time information stored in said daylight saving time information storage means in the particular region can be set again.

12. A radio controlled timepiece according to any one of claims 1 to 5, wherein said timepiece is further configured so that in a case when said particular region comprising a plurality of sub-regions each having the respective offset time difference information being different from each other with respect to said reference time information, an operational processing is performed for one sub-region selected from said plurality of sub-regions with utilizing said offset time difference information with respect to said reference time information corresponding to said particular region and said daylight saving time information used in said particular region, so as to form said local standard time information of said region, so as to form said local standard time information in other particular sub-regions can be set manually by a user of said timepiece.

13. A radio controlled timepiece according to any one of claims 1 to 5, wherein said timepiece further comprises an input means that inputs time difference information with respect to time information.

14. A radio controlled timepiece according to claim 13, wherein said input means further comprises a first input operation system for inputting the time difference information thereinto with an hour interval.

15. A radio controlled timepiece according to claim 13, wherein said input means further comprises either one, or both, of a second input operation system that corrects said time keeping information that is counted by said time keeping means with an hour interval and a third input operation system that corrects said time keeping information with a minute interval.

16. A radio controlled timepiece according to claim 13, wherein said timepiece further comprises a time difference canceling means that invalidates said time difference information stored in said storage means by operation of said input means.

17. A method for controlling a radio controlled timepiece, wherein said timepiece comprises:

a reference signal generating means that outputs a reference signal;

a time keeping means that outputs time keeping information based upon said reference signal;

a display means that displays time information based upon said time keeping information; and a receiving means that receives a standard radio wave having time information, whereby output time information output from said time keeping means can be corrected based upon reception signal output from said receiving means, and wherein said radio controlled timepiece further comprises:

an offset time difference information storage means that stores an offset time difference formed between a certain region and a particular region where said standard radio wave has been received, by setting a time information in said certain region as a standard time information;

a daylight saving time information storage means that stores therein information whether or not a daylight saving time is executed in the region where said standard radio wave has been received;

a local standard time information forming means that executes an operational processing by utilizing said offset time difference information formed between said time information of said standard radio wave as received in said particular region and said standard time information, and said daylight saving time information used in said particular region, so as to form said local standard time information in said particular region; and a time difference correction history information storage means that stores information on whether or not a user has manually corrected time difference information, wherein said method comprises the steps of:

storing an offset time difference formed between a certain region where said reference time information is formed and a particular region where the standard radio wave has been received in said offset time difference information storage means;

storing information whether or not a daylight saving time is executed in said particular region where the standard radio wave has been received in a daylight saving time information storage means;

adjusting said offset time difference stored in said offset time difference information storage means when said radio controlled timepiece has received said standard radio wave in said particular region, by utilizing information on whether or not a user has manually corrected time information when said standard radio wave has been received at an immediately preceding sampling period and which is stored in said time difference correction history information storage means, said daylight saving time information stored in said time difference correction history information storage means as obtained when said standard radio wave has been received at an immediately preceding sampling period, and said daylight saving time information as obtained when said standard radio wave has been received at the present sampling period; and adjusting said local standard time information in said local standard time information forming means based upon said adjusted offset time difference and said daylight saving time information obtained when said standard radio wave has been received at the present sampling period.

18. A method according to claim 17, wherein said method is configured so that when a fact that a user has manually performed said time difference correction operation, is stored in said time difference correction history information storage means and then said standard radio wave has been received at the present sampling period, and in a case wherein said daylight saving time information as stored in said daylight saving time information storing means when said standard radio wave has been received at an immediately preceding sampling period and said daylight saving time information as obtained when said standard radio wave has been received at the present sampling period, are different from each other, said offset time difference information storing means adjusts said offset time difference and stores said adjusted offset time difference in said offset time difference information storing means.

19. A method according to claim 18, wherein said method is configured so that, in a case when said daylight saving time information stored in said daylight saving time information storing means shows that said daylight saving time was effective at the time when said standard radio wave has been received at an immediately preceding sampling period, while said daylight saving time information shows that said daylight saving time was not effective at the time when said standard radio wave has been received at the present sampling period, said offset time difference of said offset time difference information storing means is adjusted by adding one hour to said offset time difference.

20. A method according to claim 18, wherein said method is configured so that, in a case when said daylight saving time information stored in said daylight saving time information storing means shows that said daylight saving time was not effective at the time when said standard radio wave has been received at an immediately preceding sampling period, while said daylight saving time information shows that said daylight saving time was effective at the time when said standard radio wave has been received at the present sampling period, said offset time difference of said offset time difference information storing means is adjusted by subtracting one hour from said offset time difference.

21. A method according to claim 17, wherein said method is configured so that when a fact that a user has manually performed said time difference correction operation, is stored in said time difference correction history information storage means and then said standard radio wave has been received at the present sampling period, and in a case wherein said daylight saving time information as stored in said daylight saving time information storing means at an immediately preceding sampling period and said daylight saving time information as obtained at the time when said standard radio wave has been received at the present sampling period, are same each other, said offset time difference of said offset time difference information storing means is not adjusted.

* * * * *